US007317662B2

(12) United States Patent
Unsworth et al.

(10) Patent No.: US 7,317,662 B2
(45) Date of Patent: Jan. 8, 2008

(54) GAS PROJECTION DEVICE SOMETIMES WITH A BURST DISK, PRODUCING LOUD SONIC REPORT AND SMOKE PLUME

(76) Inventors: John D. Unsworth, 7 Innovation Drive, Suite 107, Dundas, Ontario (CA) L9H 7H9; Kenneth Hammond, MIL-SIM-FX- Attention Kenneth Hammond, Tillsonburg (CA) N4G 5V3

( * ) Notice: Subject to any disclaimer, the term of this patent is extended or adjusted under 35 U.S.C. 154(b) by 312 days.

(21) Appl. No.: 11/109,401

(22) Filed: Apr. 19, 2005

(65) Prior Publication Data

US 2006/0233050 A1 Oct. 19, 2006

(51) Int. Cl.
*G01V 1/37* (2006.01)

(52) U.S. Cl. ..... 367/144

(58) Field of Classification Search ..... 367/144, 367/140; 434/16

See application file for complete search history.

(56) References Cited

U.S. PATENT DOCUMENTS

| | | | |
|---|---|---|---|
| 1,324,092 | A | 12/1919 | Warswick |
| 1,502,611 | A | 7/1924 | Boedecker |
| 2,708,430 | A | 5/1955 | Smith |
| 2,756,737 | A | 7/1956 | Resch |
| 2,831,475 | A | 4/1958 | Plymouth |
| 3,225,490 | A | 12/1965 | Ostrom |
| 3,422,808 | A | 1/1969 | Stein |
| 3,428,037 | A | 2/1969 | Capriolo |
| 3,492,945 | A | 2/1970 | Philipi |
| 4,169,403 | A | 10/1979 | Hanson |
| 5,015,211 | A | 5/1991 | Reveen |
| 5,149,290 | A | 9/1992 | Reveen |
| 5,181,775 | A | 1/1993 | Lan |
| 5,354,225 | A | 10/1994 | Hix |
| 5,529,527 | A | 6/1996 | Watkins |
| 5,620,355 | A | 4/1997 | Watkins |
| 5,634,840 | A | 6/1997 | Watkins |
| 5,772,491 | A | 6/1998 | Watkins |
| 5,803,791 | A | 9/1998 | Childs |
| 6,299,502 | B1 | 10/2001 | Cheng |
| 6,749,481 | B1 | 6/2004 | Yap |
| 2006/0233050 | A1* | 10/2006 | Unsworth et al. ..... 367/144 |

* cited by examiner

*Primary Examiner*—Daniel Pihulic
(74) *Attorney, Agent, or Firm*—Standley Law Group LLP

(57) ABSTRACT

Gas Projection Device that can take many external forms that simulate military munitions being exploded and that contain features that enhance the sound of the explosion and the appearance of smoke and attendant percussion. Such device can be controlled by many different means including electronic remote control.

31 Claims, 20 Drawing Sheets

1
4a
2a
4
2
5d
5a
5
6
7
3
8
8c
8b
8a
8
9a
9
10b
10c
10a
10
9
11b
11
11a
2b
2a
3
2J
6
6a
6a
9b
2e
9c
9a
9c
11b 1
4a
2a
5b
2i
2h
2
4
5c
5d
5b
5a
5
2
6
7
3
8
8c
8b
8a
8
9a
9
10b
10c
10a
10
9
11b
11
11a 3
2b
2J 3
2b
2h
2J
2i

Fig. 12
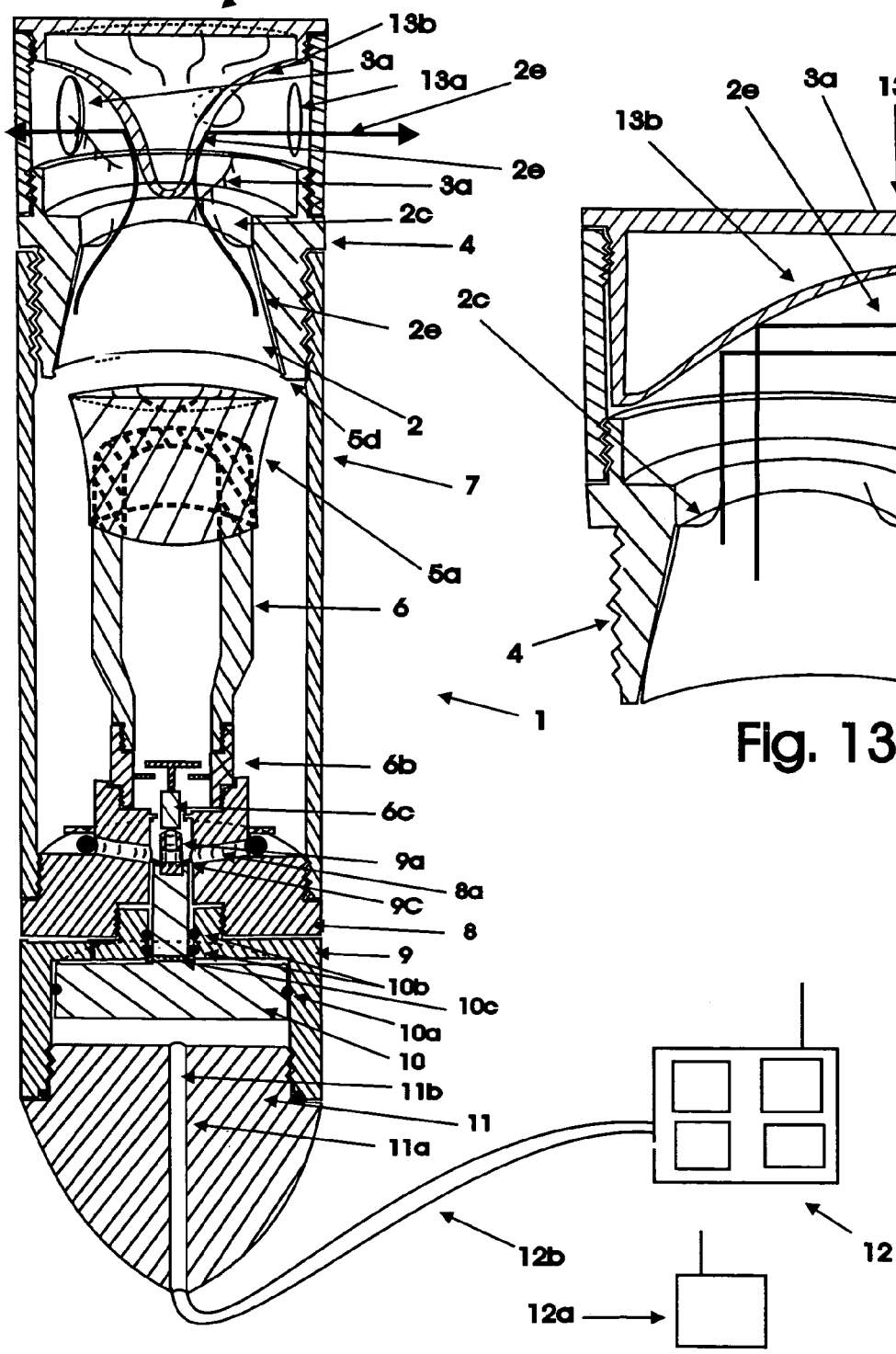
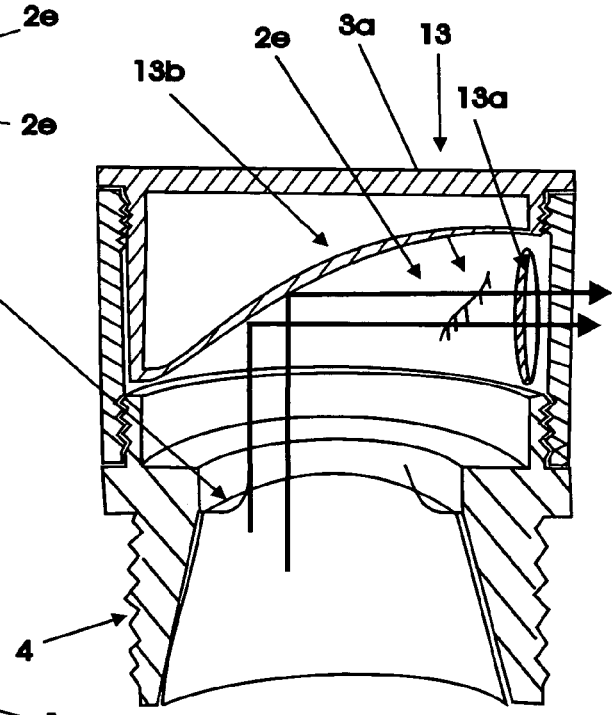
Fig. 13

GAS PROJECTION DEVICE SOMETIMES WITH A BURST DISK, PRODUCING LOUD SONIC REPORT AND SMOKE PLUME

FIELD OF THE INVENTION

The field of the invention relates to devices that utilize compressed gas and high speed valve, sometimes burst disks to create high transient gas pressures that suddenly project materials that are often accompanied by a loud sonic report, such as confetti canons, simulated explosive devices, including facsimile military weapons.

BACKGROUND OF THE INVENTION

Devices that create a loud report and simultaneously project materials utilizing compressed air or gas are well known to the art. These devices often use a burst disk which allows for the gradual increase in pressure in a chamber containing the material to be projected, and the sudden, but predictable release of the pressure and perhaps entrained material through the orifice, newly defined, by the disintegration of the burst disk.

The earliest such device is likely the popgun, which utilizes a cork which serves both as the burst disk and the material that is projected, at the sudden release of pressure.

Another such device is the spud gun or potato gun. These devices are similar to the pop guns, having a piston that incrementally increases pressure behind the combination burst disk and projected material, that is, the plug of potato pressed into the end of the barrel. At first, like the cork of the pop gun, the potato plug frictionally grips the barrel interior, with sufficient force to resist the rising pressure created by the approaching piston. At some point however the force of the compressed gas attempting to expel it from the barrel is of sufficient force, that the static friction is suddenly and catastrophically overcome, causing the plug to suddenly accelerate as the compressed gas continues to act on it. When the expanding gas, behind the cork or potato plug meets the static air, there is often a shock wave created and a loud pop. It is important to note that the gas first escaping these guns is slowed by the slower moving projectile, in front of the gas.

U.S. Pat. No. 2,831,475 by Richard I. Daniel, discloses a pop gun that has a disk that allows for the pressure to build, as a spring loaded piston is released, by a trigger, to travel down a barrel, at the end of which is a flexible split disk that at first resists the ever increasing load of the gas, but at some calculated force, suddenly deforms, and just as suddenly releases the accumulative air pressure—producing a loud report. After the release of pressure the split disk reforms for the next shot, obviating the necessity of replacing a disintegrated burst disk after each discharge.

U.S. Pat. No. 3,422,808 by Bernhard Stein, et al. discloses a gun in which compressed air accumulates in the end of a chamber, separated from a piston and payload by two closely spaced membranes, held at an air pressure higher than ambient. The two membranes act as a burst disk, resisting the accumulating external air pressure, but suddenly and catastrophically failing, allowing the compressed air to act on the piston, projecting it and the payload to the end of the barrel, where the piston is braked, while the payload continues its flight out of the barrel. In this case the failure of the burst disk is triggered by allowing the pressure between the disks to drop, effectively increasing the relative pressure of the accumulating air pressure at the end of the chamber opposite the piston and payload. While this patent describes a method of projecting an object, it does not produce a significant sonic report as the gas immediately escaping from the burst disks, is blocked by the projectile.

U.S. Pat. No. 3,428,087 by Igino Capriolo et al. discloses a compressed air pressure gun, similar to U.S. Pat. No. 3,422,808, referred to above, but instead of just two membranes, there are several. Again the gas, first escaping from the burst disk, is blocked by the projectile, resulting in a very quiet sonic report.

U.S. Pat. No. 5,015,211 by Tyrone J. Reveene, discloses a confetti cannon that relies on a blast of gas released from a compressed gas canister. This cannon relies on a rapid evacuation of the gas from the canister into the barrel of the cannon and does not utilize a membrane or burst disk to build pressure in the barrel prior to launch. This cannon is designed to project confetti plugs high in the air without concern for creating a loud sonic report or sonic shock wave. Again the projectile is in advance of the first compressed gas being released into the ambient air, and therefore slows the escaping gas, and consequently reducing the volume of the sonic report.

U.S. Pat. No. 6,749,481 by Leong Kheng Yap, et al. discloses confetti and particulate cannon that is designed to project those materials and purports to accompany the projection with a sonic report. Unfortunately, it has been found that the method taught by Yap et al. are not suitable for creating a cloud that looks like a smoke cloud, while at the same time creating a loud bang that simulates an explosion of an explosive device, such as an artillery shell or landmine. The reason for this is that the pressure builds behind the confetti or particulate, which acts to compress it and tends to form it into a plug. When the burst disk finally fails, releasing the confetti or other payload, those materials tend to defuse the shock wave that would otherwise be produced if those materials were not present. The payload then slows the advancing of the gas that would otherwise create a sock wave at the gas/air interface, if not so impeded. The other disadvantage with this method is that the compressed payload has a tendency to eject from the barrel of the cannon as a plug. For those applications where one requires the immediate creation of a diffuse cloud of smoke or cloudlike zone, near the end of the barrel, it is preferable to have the compressed air create a fluidized bed within the cannon chamber, so that as it is expelled, it does so a highly aerated manner.

It is important to note that the requirements for creating a loud sonic report are different from those that are ideal for transporting the payload. Generally the creation of a shock wave that produces a loud report is best accomplished by creating a short, high pressure, high velocity pulse. However, the transport of the payload generally requires a longer duration flow of air that entrains the particles and projects them out of the gas projector.

What is needed therefore is a two step method whereby: first, the sonic shock wave is produced by the gas being released by the burst disk, unimpeded by payload. Second and later, the payload is transported by being entrained by lower pressure, longer duration gas movement.

Another difficulty with the devices of the prior art is the tendency for their mechanism to become fouled with particulate matter or other payload material.

It is the purpose of this invention to produce a high pressure pulse of compressed gas, unimpeded by the payload, at that moment when a valve or the burst disk substantially instantaneously opens.

It is the purpose of this invention to fluidize the payload of particulate matter or confetti prior to, and/or it is being ejected from the barrel of the gas projector.

It is the purpose of this invention to concentrate, project and direct the sonic energy and/or shock wave, to enhance the sonic report.

It is the purpose of this invention to create a diffuse cloud or smoke cloud that accompanies the loud sonic report, both to simulate the effects of a pyrotechnic explosion.

It is the purpose of this invention to create one or more vortexes that will more efficiently entrain particular matter and transport it for longer distances, and also to create an percussive force that will simulate the air blast of a real explosion, although at much lower and safer energies.

It is the purpose of this invention to separate the mechanism from the particulate matter or payload by the radial expansion and contraction of a simple and inexpensive "O" ring.

It is the further purpose of this invention to create preferred embodiments that have the appearance of general military ordinance and pyrotechnic devices; and further to create realistic sounds and visual effects that simulate detonations of those real devices.

BRIEF DESCRIPTION OF THE DRAWINGS

FIG. 1 also illustrates the sonic energy concentrator 5*a*.

FIG. 9 also illustrates a hat type sonic energy concentrator 5*a* that is designed to be placed directly on the compressed gas cartridge 6.

FIG. 10 also illustrates a remote electronic switch and radio transmitter 12*a* that allows for control of the gas igniter 1*a* at greater distances in combination with a receiver on the controller 12.

FIG. 12 is a cross-sectional perspective view of a gas projector 1 with the hat type sonic concentrator 5*a* on the gas cartridge 6, and that has a deflector cap 13 which incorporates vanes 13*b*, which efficiently redirects the projected matter 3*a* and escaping gas in flow 2*e* in an approximate 180 degree pattern out the ports 13*a* in the deflector cab 13. FIG. 12 also illustrates how this gas projector, which as a profile similar to an artillery shell, can be made to detonate remotely with controller 12 and electronic trigger 12*a*.

FIG. 13 is a cross-sectional perspective view of a deflector cap 13 and vane 13*b*, which directs the gas flow 2*e* and entrained matter 3*a* at approximately right angles and in a narrower field than the deflector cap 13 illustrated on FIG. 12, out of the side port 13*a* or ports of the deflector cap 13.

FIG. 14 also illustrates how this gas projector, which has a profile similar to an artillery shell, can be made to detonate remotely with controller 12 and electronic trigger 12*a*.

FIG. 17 also includes an optional spring or Belleville washer 10*c* that keeps the orifice of the compressed gas cartridge 6 from being inadvertently pierced or opened, before force 11*b* is applied. FIG. 17 also illustrates an antifouling valve 8*d* and shock energy concentrator 5*a*.

In FIG. 18 the accessory cap secures a vortex ring generator disk 4*b*.

FIG. 21 also has a sonic energy concentrator 5*a* and diverter vane 13*b*, and has attached a vortex ring generator 4*c* as an accessory to the standard burst hat seal 2.

FIG. 25*a* illustrates the mortar as it is being dropped down the mortar tube 19. FIG. 25*b* illustrates the mortar at the point where the mortar tube projection 19*a* forces the compressed gas cartridge 6 into the piercing lance 19*a*, and pressurizes chamber 7. FIG. 24*c* illustrates the point at which the burst disk has burst 2*c*, and the mortar nosecone 17 starts exiting the mortar tube 19.

FIG. 26*a* and FIG. 26*b* both illustrate an "O" ring valve 8*b* that prevents particulate matter 3 and 3*a* from gaining access to channel 8*a* and lance 9*a*.

FIG. 27*a* and FIG. 27*b* both illustrate a "O" ring valve 8*b* that prevents particulate matter 3 and 3*a* from gaining access to channel 8*a* and lance 9*a*.

DETAILED DESCRIPTION OF THE INVENTION

The simulation of varied military weapons and munitions is necessary for the proper training of troops. These simulated weapons must be realistic in providing a loud bang or report that would normally accompany their discharge, and also an accompanying smoke and/or dust cloud. At the same time the devices must be safe, not just in use, but when stored and transported by untrained recruits.

For safety reasons, the devices described in this disclosure are powered by compressed gas, supplied in tanks or cartridges of various sizes. It is to be understood however, that the invention is not limited to this means of power, and the devices could be adapted to be powered by combustible materials and be within the ambit of the invention.

Although this invention is directed at producing simulated military devices, some preferred embodiments of the invention can be used for entertainment, in place of pyrotechnics. Other preferred embodiments of the invention can also be used to project materials, such as confetti, where an accompanying loud sonic report is required.

It should also be appreciated that although the preferred embodiments produce a loud sonic report and the transport of a payload, some preferred embodiments may do only one or the other.

The invention and its many embodiments describe a method of separating the sonic report from the transport of payload. In this patent, payload can refer to any material that is transported out of the device, and can include particulate matter such as aggregate, baby powder, talc, or paper such as confetti or a liquid, aerosol, or gas. As described above, the creation of the sonic report is due mainly to propagation of a shock wave caused by the bursting of a burst disk. The use of a burst disk is the most practical and inexpensive method of ensuring a rapid release of compressed gas that is substantially instantaneous, that collides with the ambient air, thus creating a loud bang. To create a loud report, the escaping gas need only travel a short distance, but do so at high velocity. The requirement that it be at the highest possible velocity, means that it must be unencumbered by foreign material, such as parts of the payload. That is, it must not have been slowed down by entraining foreign materials, and accelerating them. The resonant frequency of the gas volume that powers the sonic stroke, immediately after the bursting of the burst disk is of importance, as the energy should be compressed into a relatively short pulse. Also of importance is that the sonic report propagates in all directions, and that which returns back into the device, must be redirected back out of the barrel. As mentioned above, the transport of the payload requires a completely different energy regime. Transport of the payload requires a long duration, steady flow of gas out of the device, and for this reason, the invention separate these two regimes.

Figures 1, 2, 3, 4:
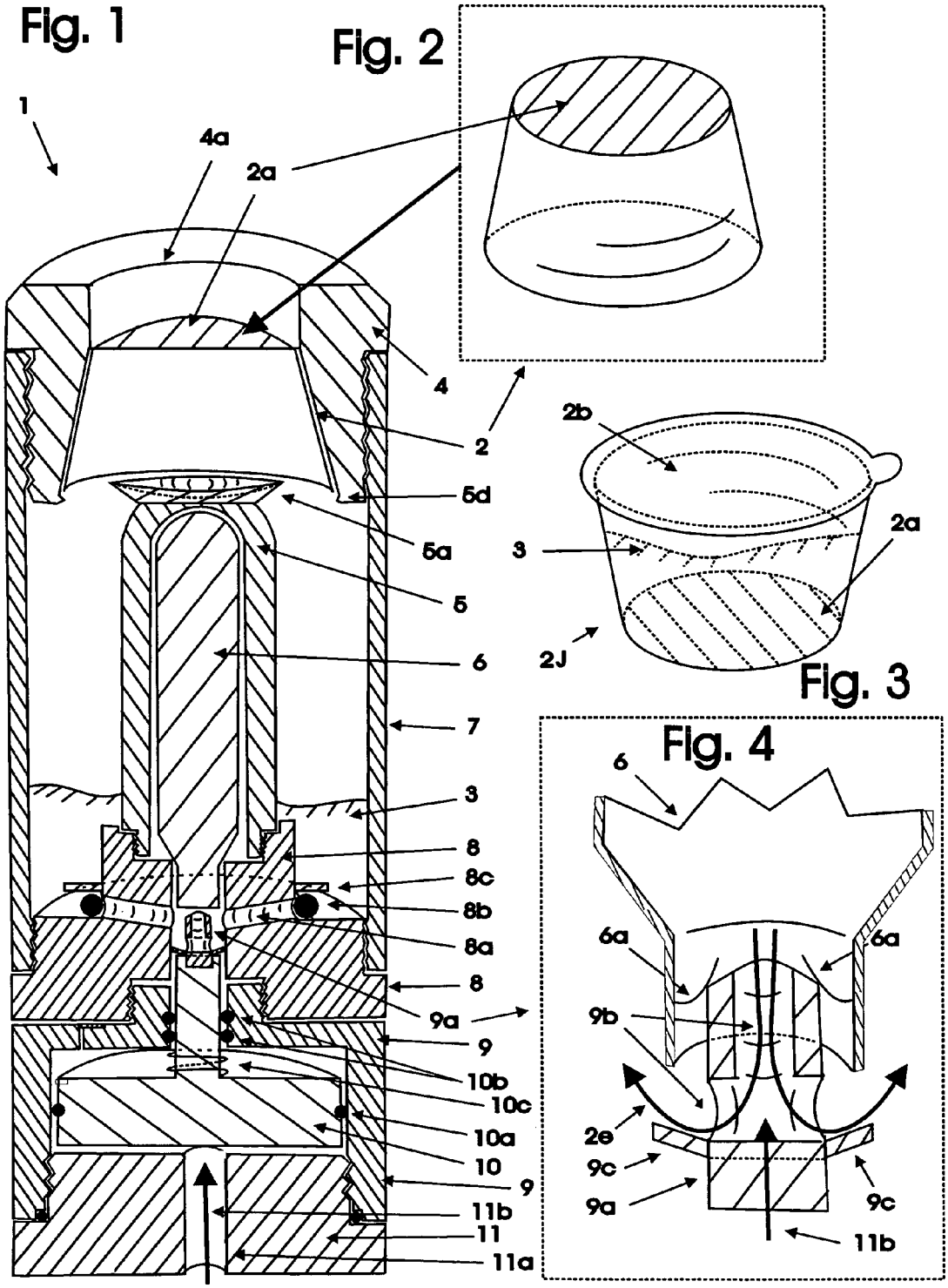
FIG. 1 is a cross-sections perspective view of the compressed gas projector 1, that includes a compressed gas cartridge 6 that has a pierce seal valve 6*a*, as illustrated in detail FIG. 4, and a vented lance 9*a*, "O" ring anti-fouling valve 8*b*, piston 10 and burst hat 2 with incorporated burst disk 2*a*.
FIG. 2 is a perspective view of burst hat 2 incorporating conic-cylindrical sides that form a seal when pressed against burst hat seal 4, and a burst disk 2*a*.
FIG. 3 is a perspective view of the burst hat 2 forming a burst hat container 2*j* by the addition of a peal top 2*b*, or other top, containing a selected portion of matter 3 that will be projected from projection device 1 for the particular application, after being poured into barrel 7, where it will be fluidized by jetting action of gas venting out of passages 8*a*.
FIG. 4 is a cross-sectional perspective view of the compressed gas cartridge 6 being pierced by the vented 9*b* lance 9*a*, and the expelled gas being directed by vanes 9*c*.
Figure 10:
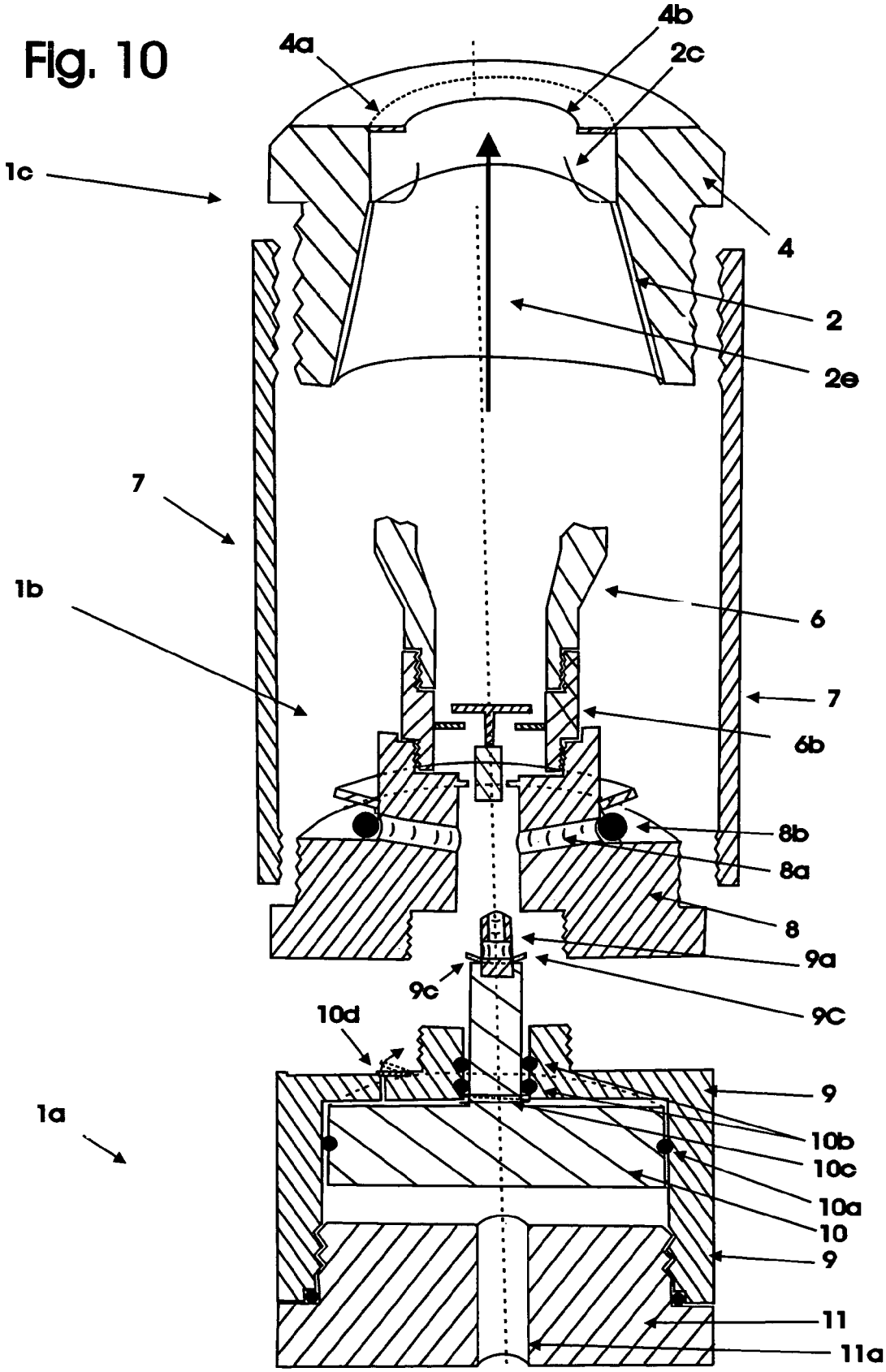
FIG. 10 is cross-sectional perspective view of principal parts of the gas projector that incorporates an igniter 1*a*, comprised of base 11, cylinder 9, piston 10 and lance 9*a*; the gas delivery system 1*b*, comprised of compressed gas cartridge 6, valve 6*b*, and gas distributor/fluidizer 8; the barrel or chamber 7; and the pressure release unit 1*c* comprised of a burst hat seal 4, that in this case includes a vortex ring initiator 4*a*.

The invention can best be described by referring to the drawings that accompany this patent. FIG. 1 incorporates many aspects of the invention. The device illustrated on FIG. 1 can take many shapes and guises, and can for example have rocket fins and nosecones attached. The device illustrated in FIG. 1 is comprised of a chamber or barrel 7 that contains the payload, in this case particular matter 3, such as baby powder. The bottom portion of the device, referred to as the igniter, and identified as 1*a* on FIG. 10, projects a vented lance 9*a*, that either opens a valve 6*b* attached to a compressed gas cartridge 6, or pierces a seal that allows the compressed gas to exit the tank at relatively high volume. FIG. 1 illustrates the igniter that is about to pierce the seal. The igniter in this embodiment of the invention includes a piston 10 that travels up and down, a cylinder 9 in response to a force 11*b* that acts on the bottom of the piston 10. This force 11*b* can be supplied by a simple mechanical rod or be in the form of a gas or liquid volume, traveling up and down the tube 11*a*, in the base 11. FIG. 1 illustrates the force 11*b* acting in an upward direction that forces the piston 10 and the attached vented lance 9*a*. FIG. 1 also illustrates an optional spring 10*c*, which compresses and resets the device upon recovery, after the upward force 11*b* is relaxed. To prevent the escape of gas, "O" rings are employed at certain connections, where gas might otherwise escape and two such "O" rings are illustrated 10*a*, 10*b*. FIG. 10 illustrates a gas relief valve 10*d*, which allows the piston to travel up the cylinder, without compressing the gas above. The vented lance 9*a*, that is suitable for piercing seal type gas cartridges 6, is illustrated in more detail on FIG. 4. The vented lance 9*a* has attached a rim 9*c* that deflects the escaping gas into the waiting port and passage 8*a* on FIG. 1. This rim 9*c* prevents condensate, caused from the cool escaping gas, to enter between the piston 10 and cylinder 9, which might otherwise seize them. The vented lance 9*a* pierces the seal 6*a* and allows the compressed gas to escape through the lance vents 9*b* and exits as a stream 2*e*.

The compressed gas is then directed by rim 9*c* to ports and passages 8*a* in gas distributor 8. FIG. 1 shows two such ports 8*a*, but many preferred embodiments can have any number of such means of transporting the gas. To prevent the fouling of the passages, an "O" ring 8*b* is placed around the gas distributor in such a manner that when the gas is passing through the passage 8*a* with sufficient force, it will radially expand the otherwise sealing "O" ring 8*b* and unseat it allowing for the passage of gas around it, and into the chamber or barrel 7. When the gas drops below a certain pressure, the "O" ring 8*b* will reseal the passage and thereby prevent any particulate matter remaining in the chamber 7 from back flowing into the passage 8*a* and beyond. Some preferred embodiments include a retaining rim or pegs 8*c* or other such restraining means, to ensure that the "O" ring 8*b* does not roll up or down the gas distributor 8, with it is in its expanded state. The gas passing out of the passage 8 will rapidly fluidize the material that has been placed in the canister 7. The fluidizing of this material will greatly assist in later projecting it out of the gas projector 1. The preferred embodiment illustrated in FIG. 1 includes a gas cartridge 6 that is contained within a holder 5, but can of course be secured by many other convenient means. FIG. 1 has attached to it or incorporated into it a dish shaped platform 5*a* that is a sound and pressure reflector and that is referred to herein as a sonic energy concentrator. This dish or horn shaped form 5*a* is meant to be illustrative of a large class of forms that focus or reflect sonic energy, including horns, bells to name just a few. Other preferred embodiments may however utilize forms that are flat or convex; to disperse the sound and make it more omni directional as it exits the chamber. The other purpose of the sonic energy concentrator 5*a* is to establish a secondary resonant cavity between the said sonic energy concentrator and the burst disk 2*a* it faces. Since the gas pulse that gives rise to the shock front need only be short in length and duration, but high in velocity, it is advantageous to have a relatively short resonant cavity. It is to be understood that FIG. 1 is only illustrative of one aspect of the invention, and that the size, shape and location, relative to the bottom surface of the burst disk 2*a* will vary depending upon many factors, such as the size of the primary resonant cavity, the distance beneath the sonic energy concentrator 5*a*, the pressures at which the system operates and the gas that is used as an energy source, to name a few.

At the top of the cavity is located a burst hat 2, that includes a burst disk 2*a*, which is snapped into place over a small ledge 5*d*, as illustrated on FIG. 1, or by other convenient means well known to the art. The burst hat 2 is shaped to seal with burst hat seal 4, when the pressure in cavity 7 increases above the pressure outside the cavity. While FIG. 1 illustrates a hat shaped burst disk, this is merely illustrative of a class of burst disks that can for example be simple wafer like disks sealed at their perimeters, by means well known to the art. The purpose of the burst disk is to contain the increasing pressure within the chamber as the compressed gas cartridge empties; and then at some predetermined pressure, to fail suddenly, allowing the gas to escape out through the orifice 4*a*. This burst disk serves as an inexpensive high speed valve, which of course some preferred embodiments might substitute.

As described above, when the burst disk 2*a* or substituted high speed valve opens, the high pressure gas accelerates quickly in the preferred embodiment, as there is no payload to impede it. This acceleration is aided by the tapered burst hat 2 that forms a venturi and the sonic energy concentrator with relatively short pulse resonance. A shock front is created when this high velocity gas meats the relatively slow moving ambient air, immediately adjacent to the boundary of the disk, when it breaks. The result is a shock front, shock wave and resulting sonic report.

Figure 5:
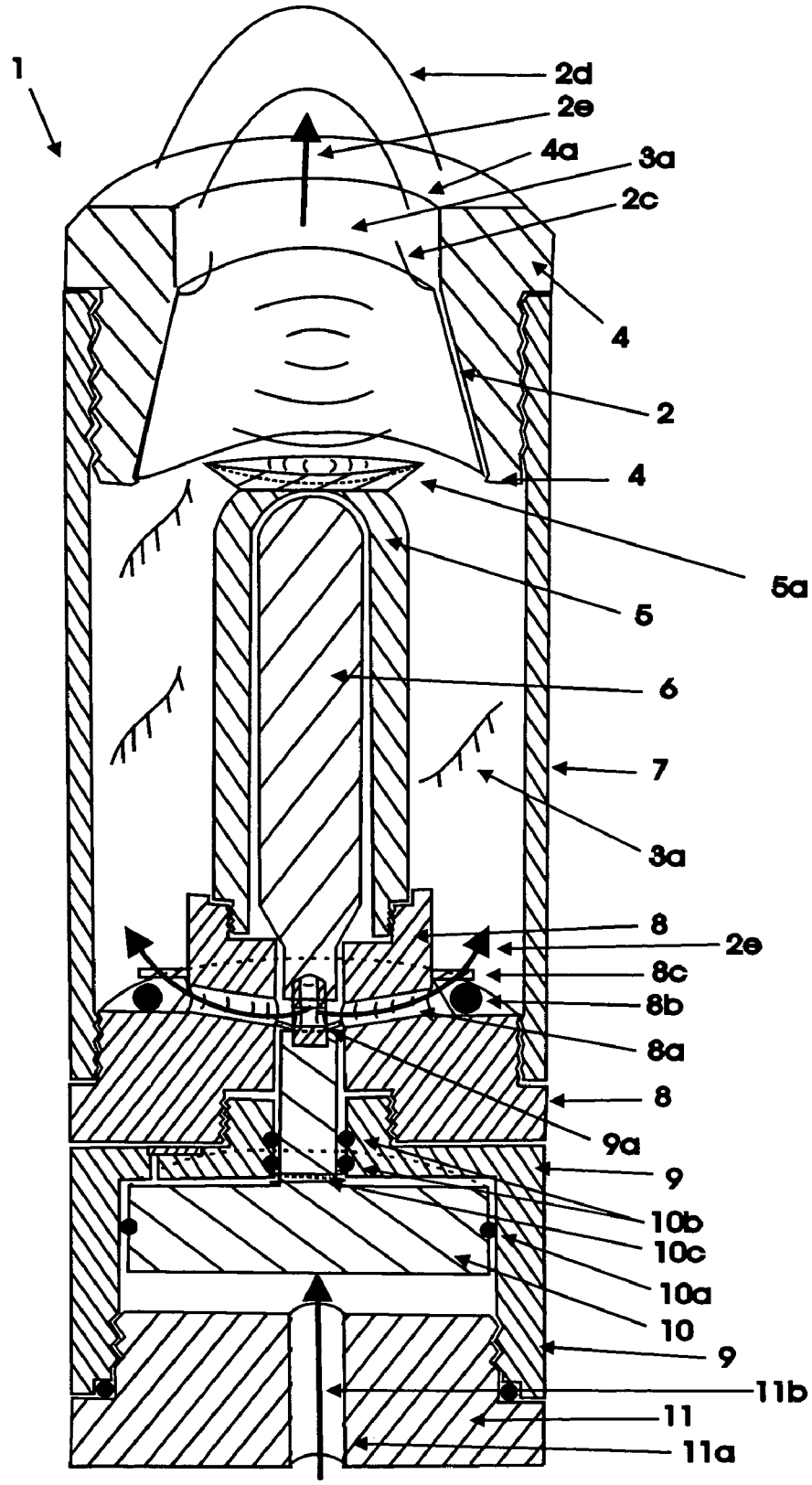
FIG. 5 is a cross-sectional perspective view of the pierce seal type gas projector illustrated in FIG. 1, as the gas is released from the compressed gas cartridge.

FIG. 5 illustrates the system at the point that the piston 10 has moved up the cylinder 9 in response to upward force 11*b*, causing the gas to escape from the breached seal 6*a*, and the gas to pass into the chamber 7, as above described. FIG. 5 illustrates the burst seal having burst 2*c*, the payload material 3*a* starting to exit the chamber 7. Also illustrated between the sonic energy concentrator 5*a* and the just burst disk, is the secondary resonant cavity, that quickly upon the bursting of the burst disk 2*a*, assumes the role of a sound bell or horn, directing the sound of the shock wave produced, outward, away from the chamber 7 and accelerating the shock front formation.

Just after the burst disk 2*a* fails 2*c* and generally following the sonic report, the payload, in this example, particulate matter, having been already fluidized, is entrained by the large volume of slower moving, lower pressure gas, that then exits the chamber 7, through the orifice 4*a*.

While the preferred embodiment illustrated in FIG. 1 and FIG. 5 illustrate a conic-cylindrical hat 2 that incorporates the burst disk 2*a*, the hat can also contain part or the entire payload. While the preferred embodiment of the invention, has the escaping gas acting on the burst disk first, to create a loud report, as described above; there may be circumstances where one may wish to project the material with higher or in a more clustered form, in which case it may be advantageous to fill the burst hat 2 with such material and contain it with a cover to form a burst hat container 2*j*, such as a peal top 2*b*, well known to the art. In such preferred embodiments, some or all of the other features of the invention may be utilized and therefore still be within the ambit of the invention.

One embodiment of the invention is to convert the burst hat 2 into a burst hat container 2*j* for the material 3 to be projected by the gas projector 1 by adding a peal top 2*b* or other top that can be removed or pierced. In most cases the burst hat container 2*j* is filled with the precise amount that will give a particular effect, for a particular device. These burst containers 2*j*, can then be provided already packed in handy portions, and in most cases the user will simply empty the ideal portion into the chamber 7, and then place the empty burst hat container 2 in the burst hat seal, as illustrated in FIG. 1.

Figures 6, 7, 8:
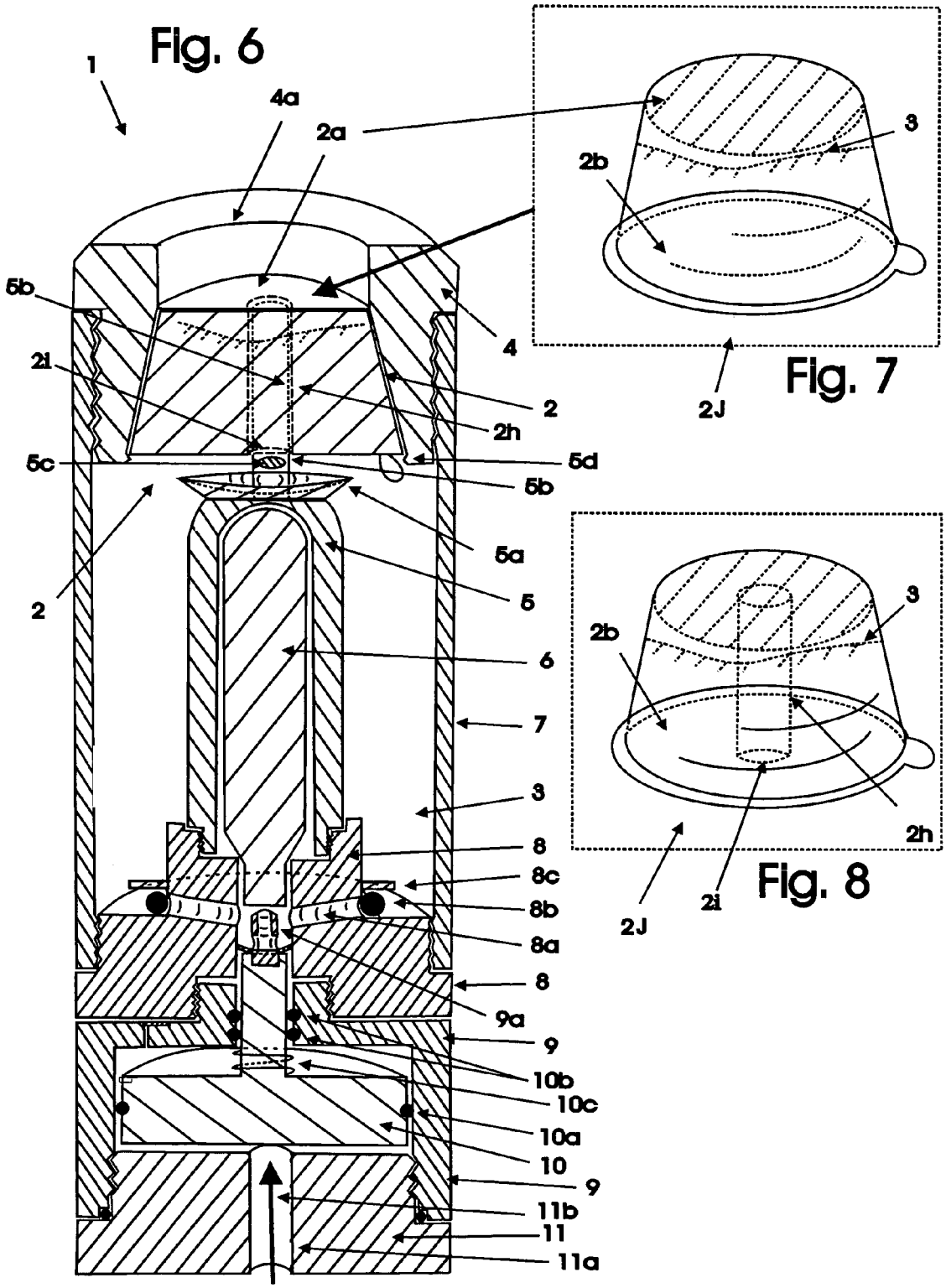
FIG. 6 is a cross-sectional perspective view of a compressed gas projector having a container 2*j* that utilizes a channel 2*h* and 5*b*, to introduce high pressure gas directly beneath burst disk 2*a*, and then fluidizes the particulate payload immediately beneath the burst disk 2*a*, and immediately above the sonic energy concentrator.
FIG. 7 is a perspective view of the burst hat container 2*j*, with a peal top 2*b* in place, retaining the matter 3 that will be projected out of orifice 4*a*.
FIG. 8 is a perspective view of a burst hat container 2*j*, with channel 2*h* included and hole 2*i*.

FIG. 8 illustrates the packaging of the material in a way consistent with one of the preferred embodiments that is to ensure that the initial gas pulse that bursts the disk is unimpeded with payload. The burst hat container 2*j* illustrated in FIG. 8 has a partly or wholly vacant channel 2*h* running from the peal top 2*b* to the burst disk 2*a*. The channel can be created by inserting a tube preferably made of material that will maintain its integrity only briefly to allow the initial pulse of gas to break the burst disk 2*a* and create the shock front. The tube or member of other suitable shape can for example be made of paper or friable material such as ceramic or may simply be formed by pressing or adding a binder to the particular matter that forms the payload. For example, if the payload is talc, a tube might be pressed into the talk, after it is poured into the burst hat container 2*j*, and then the surface of the tube so formed could be sprayed or imparted into it by other well know means, a binder, that would stabilize the tube, and yet, after providing a channel for the initial pulse of gas, collapse or partly collapse, so the material might better be transported out of the orifice in a uniform spray.

The hole adjacent to the peal top 2*i* shown in FIG. 8 can extend through the top or can be broken open by simply pushing the inverted burst hat onto the shock tube 5*b*. Some embodiments of the invention include a shock tube 5*b* as shown on FIG. 6, most of which include some means, such as a port 5*c* for the gas to enter the lumen of the shock tube 5*b* and gain access to the bottom of the shock disk 2*a*. In the example illustrated on FIG. 6, this point of entry is a hole 5*c* just above the sonic shock concentrator 5*a*. Other embodiments of the invention have no shock tube and rely instead on the channel 2*h* as shown of FIG. 8, and simply have a whole 2*i* precut or that can be easily removed prior to insertion. Other embodiments have points of weakness around the hole that allow the cover of the hole 2*i* to fail when the pressure begins to rise in the chamber. Other embodiments utilize other methods well known to the art of packaging.

Figure 9:
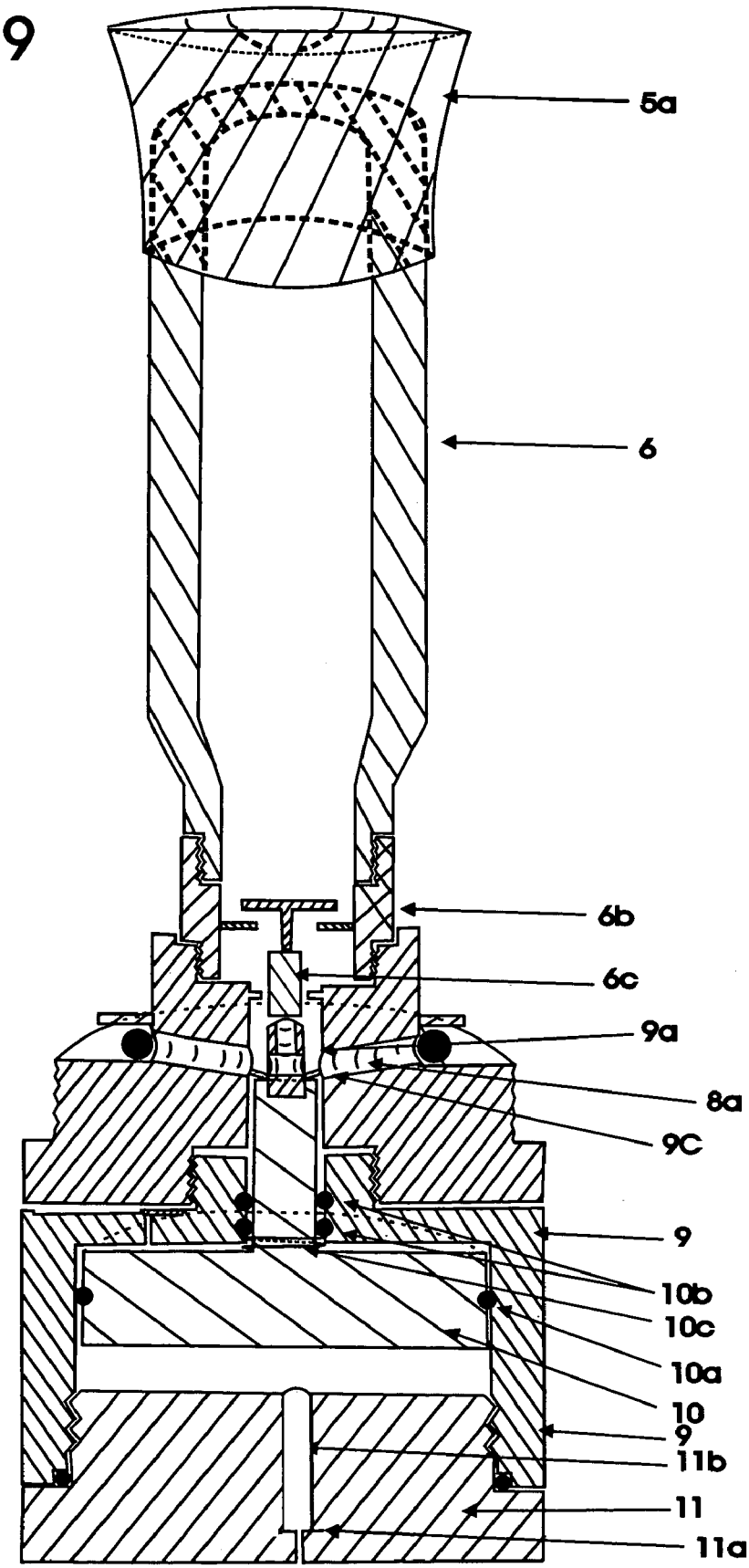
FIG. 9 is a cross-sectional, perspective view of part of the gas projector that illustrates the high-flow valve 6*b*, 6*c* type, as opposed to the pierce valve type, illustrated in FIG. 1.

As mentioned above, some embodiments of the invention rely on a high volume valve to control the emptying of the compressed gas cartridge 6, rather than a pierce disk, as illustrated on FIG. 1. FIG. 9 illustrates the system with such a valve 6*b*, in this example connected directly to the said compressed gas cartridge 6. FIG. 9 includes an extension 6*c* which is acted upon by the lance 9*a* to open the flow of gas to the gas distributor, and in this example channel 8*a*. The high volume valves are generally used for larger gas cartridges and the pierce disks for the smaller ones. FIG. 9 also illustrates another embodiment of one aspect of the invention, being the sonic energy concentrator 5*a*. In this embodiment, the device has a base which fits over the compressed gas cartridge 6. These ease of installation means that various shaped sonic energy concentrators 5*a* can be used to address particular performance requirements, such as the shape and intensity of the sound field generated by the device. For example, for some applications, a very narrowly focused, high intensity field will be required, necessitating a sonic energy concentrator with a deeper dish at the top of the unit. Other applications would require a flatter or even convex surface to vary the shape and intensity of the sonic field. The design specifications of all these embodiments of the invention will depend upon the particular circumstances of the device dimensions, gas pressures used, type of energy inputs, to name just a few.

FIG. 10 is view of the principal components of a typical gas projection system. They are: the igniter unit, 1*a*; the gas delivery system, including the gas distributor, 1*b*; and the pressure release unit, 1*c*.

Figure 11:
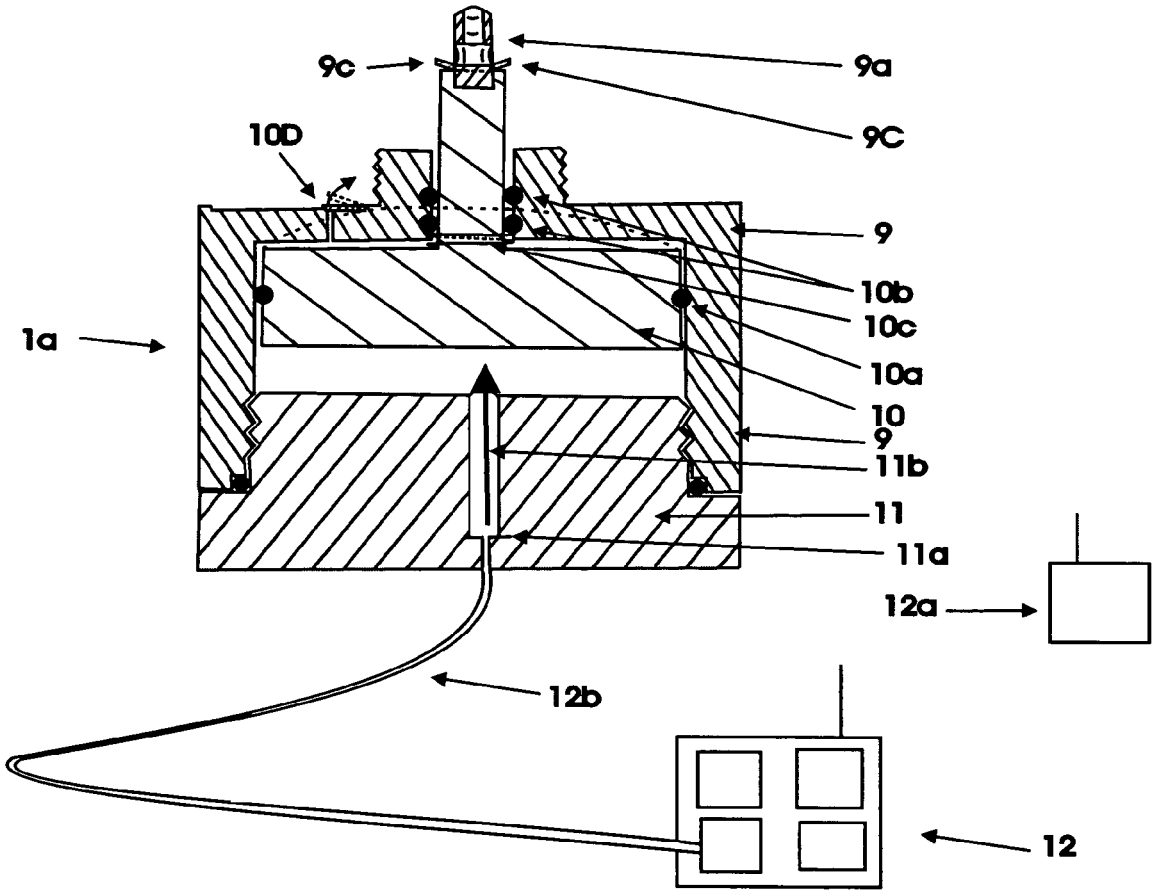
FIG. 11 is a cross-sectional perspective view of an igniter 1*a* that has a controller 12 that controls gas or liquid flow through a tube 12*b* to the orifice 11*a*, exerting a force 11*b* which causes piston 10 to move in desired direction, in this case overcoming the opposing force of the spring 10*c*, to move the lance 9*a* upward.

FIG. 11 illustrates the typical igniter unit 1*a*. In this example, illustrated in FIG. 11, the piston 10 movement is controlled by a fluid or gas entering the channel 11*a*, via a tube or conduit 12*b*. The controller 12 controls the delivery of this controlling gas or fluid and its design is well known to the art of fluid and gas controllers. In some embodiments, this controller can in turn be controlled by a more remote wireless, or wired device 12*a*. Although this example of the embodiment illustrated on FIG. 11 utilizes a gas or fluid media to push up the piston 10, other embodiments would utilize other means well known to the art to control the motion of the lance 9*a*, and these might be wholly electric or such other means well known to the art.

FIG. 12 is meant to illustrate one embodiment of the invention that includes a redirecting means for the sonic energy and subsequently the matter that is ejected out of the chamber 7 of the gas projector 1. In this example an auxiliary cap 13 is screwed onto the top of the pressure release unit, in this case the burst hat seal 4, with treaded top. The flow of compressed gas 2*e* passes the burst disk 2*c* and then is redirected at 90 degrees, in approximately a 180 degree field by an approximately inverted conic section 13*b*, and thence through ports of various sizes and locations, 13*a*. FIG. 12 also illustrates the use of a sonic energy concentrator 5*a* of the type illustrated in FIG. 9, that fits over the compressed gas cartridge 6. This example illustrates the many shapes the basic gas projector 1 can assume. In this case the base 11 is shaped like the head of an artillery shell. This preferred embodiment might be used to simulate a road-side bomb made from an artillery shell. This unit might be used to train soldiers on how to locate, avoid and disarm such devices. In this example, the embodiment illustrated includes a remote control device 12 and 12*a* for igniting the unit, as earlier described. It is important to note that this example of a preferred embodiment of the invention uses the same burst hat 2 as in FIG. 1, and is retained by the same snap in ledge 5*d*. FIG. 13 illustrates an auxiliary cap 13 that has a more focused redirector. In this case a redirecting member 13*b* turns the gas flow 2*e*, at approximately right angles and redirects the flow out a port 13*a*.

Figure 14:
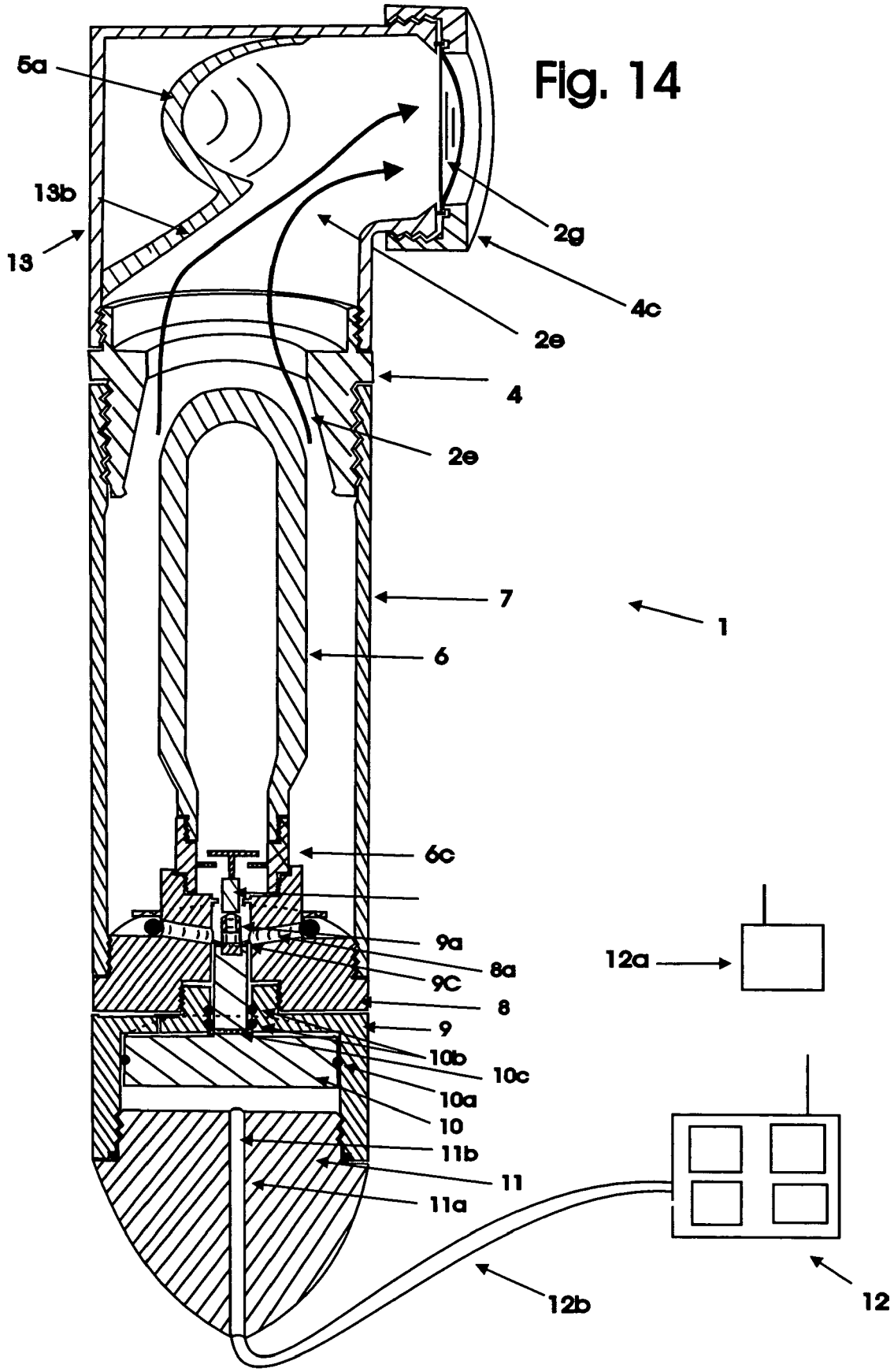
FIG. 14 is a cross-sectional perspective view of a side-firing type of gas projector 1 that includes a sonic energy concentrator, 5*a*, a direction vane 13*b* and a wafer burst disk 2*g*, contained in a holder 4*c*.

FIG. 14 illustrates another embodiment of the invention that allows for redirection of the gas flow 2*e* and various means of attaching the burst disk. In this embodiment of the invention the standard gas projector 1 is fitted with a high volume valve 6*c*, with remote controller 12 and 12*a*, with a base 11 shaped like an artillery shell. The burst hat seal 4 can accommodate a burst hat 2, being retained by ledge 5*d*; or the wafer burst disk 2*g* can alternatively clamped in by retainer ring 4*c*. FIG. 14 also illustrates a sonic energy concentrator that is meant to work most efficiently in the mode where the wafer like burst disk 2*g* is located at the retention ring 4*c*. For this preferred embodiment the sonic energy concentrator 5*a* creates a very efficient secondary resonant cavity, and also acts as a broadcast horn to project the sound in the desired direction. FIG. 14 also includes a redirecting member 13*b*, which is in this case blended into the sonic energy concentrator. As can be readily appreciated, from the forgoing examples, the sonic energy concentrator can take many forms, but still be within the ambit of the invention. If the burst hat 2 is located in the burst hat seal 4; burst disk 4*c*, is not normally used. However, for some applications a staged burst sequence might for certain applications be desired, especially where very high energy sonic booms are required. For these applications the secondary resonant chamber might be pumped by utilizing an intermittent pulse created by first pulsing the valve 6*c*, and then using a high speed valve in place of the burst disk 2*a* or alternatively, the burst disk 2*a* might be of the split type, well known to the art, and disclosed in U.S. Pat. No. 2,831,475 by Richard I. Daniel, that would permit intermittent opening and closing of the seal as the pressure in vessel 7 increased and then was relived by the temporary opening of the split seal, and as the pressure dropped with its release, the split seal would reseal, and the pressure would rebuild for another cycle. If a high speed electronically controlled valve is used in place of the burst disk 2 at the burst hat seal 4 and a electronically controlled high speed valve is used at 6*c*, and perhaps a high speed valve is used in place of the burst disk 2*g*, and the opening and closing of the valves are coordinated, to maximize resonance in the secondary resonant chamber, pumped by harmonic resonance in the primary resonant chamber 7, then very intense sonic pulses can be created. The pulse finally exiting the orifice at 4*c*, can also be transformed into a vortex, by attaching a vortex generator ring 4*b*, described below.

Figure 15:
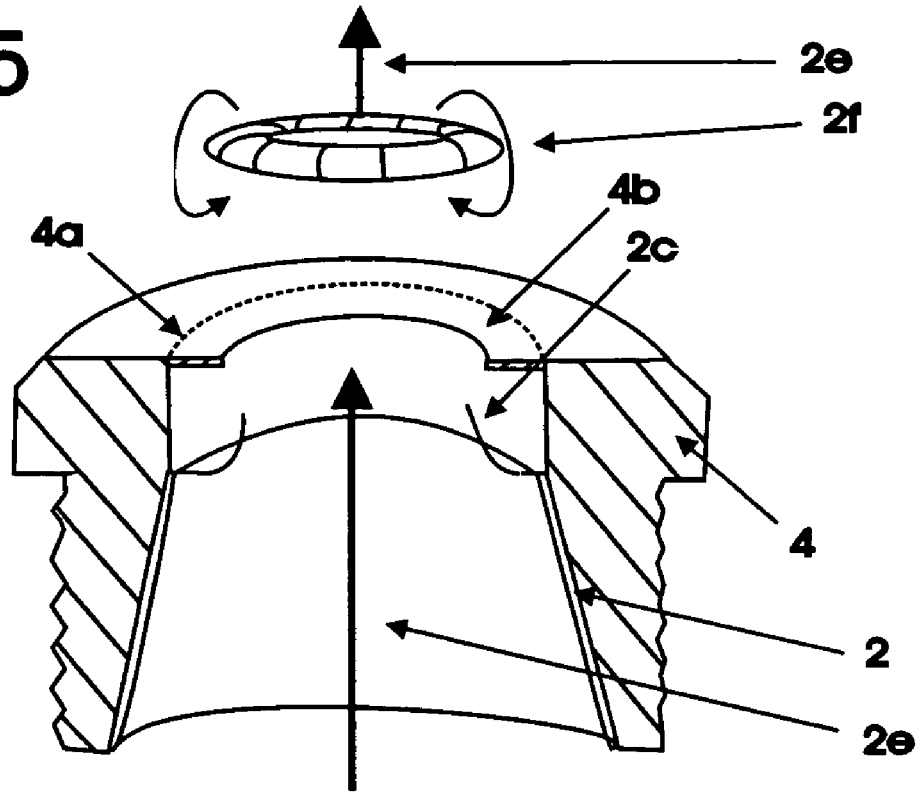
FIG. 15 illustrates a vortex ring generator 4*b*, that in this example is attached or forms part of the burst hat seal 4, and produces a vortex 2*f* that travels energetically in direction 2*e*.

FIG. 15 illustrates how a vortex ring might be attached or incorporated into the pressure release unit, in this case the burst hat seal 4, with standard orifice 4*a*, which has added a thin ring 4*b* that is designed to slow the periphery of the gas flow 2*e* as it exits the unit. As it does so, the centre of the gas flow speeds up relative to the flow on the periphery. If the flow of the gas 2*e*, takes the form of short pulses, vortexes will be formed at each pulse. A vortex is very stable and can entrain particulate matter and carry it for distances far greater than a simple stream of gas, which quickly diffuses. This feature allows the invention to produce much more realistic mushroom clouds that occur with conventional explosions. The vortex also will impart a percussive impact which can be felt by a person its path. It is a feature of this invention that makes the device much more realistic in safely simulating the sounds, smoke and with this feature the percussive impact of an exploding device.

The actual dimensions of the rings, to create such an effect for the many conditions that will arise for the various embodiments of the invention are well known to the art of vortex generation. Suffice it to say, that these various implementations are all within the ambit of this invention. In FIG. 14 a simple arrangement might be to have a burst hat 2 at burst hat seal 4, and a vortex ring generator located at ring retainer 4*c*. This arrangement would deliver a pulse to the vortex ring generator, with sonic concentration and horn amplification by the sonic energy concentrator 5*a*. If a split type of burse disk is substituted for the burst seal 2*a* in the burst hat 2, and is located in burst hat seal 4, the controller can direct the valve 6*c* to release an intermittent pulse, which results in a series of reports. If a vortex generator is added at 4*c*, these pulses can be converted in vortexes.

Figure 16:
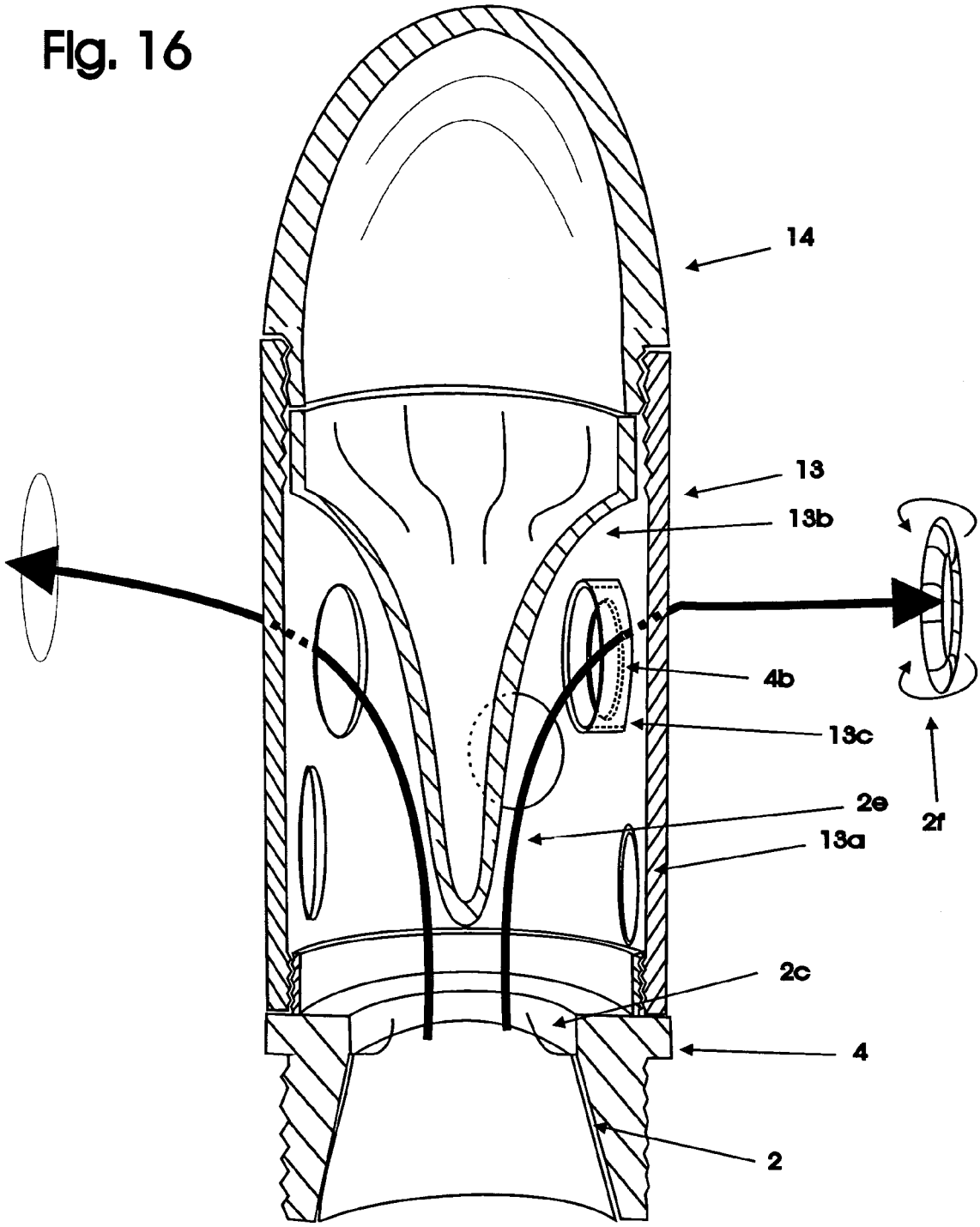
FIG. 16 a cross-sectional perspective view of a deflector cap 13, with tapered cap 14 that is shaped to have the appearance of a bullet or artillery shell. The side-firing 180 degree deflector includes a vortex generator 13*c* that produces a vortex 2*f*.

FIG. 16 illustrates how an auxiliary redirector 13 can incorporate vortex ring generators as well as simple ports. In this example the inside edges of the port are as thin as possible, and a tube 13*c* is formed around the port, having an inside diameter somewhat larger than the diameter of the port 13*a*. As mentioned above these relative sizes will vary depending upon the conditions that prevail, and these design parameters are well known to the engineering art of fluid dynamics and mechanical engineering. A nosecone 14 has been attached to the embodiment illustrated on FIG. 16. While only one vortex 4*b* generator is shown on FIG. 16, any number can be utilized.

Figure 17:
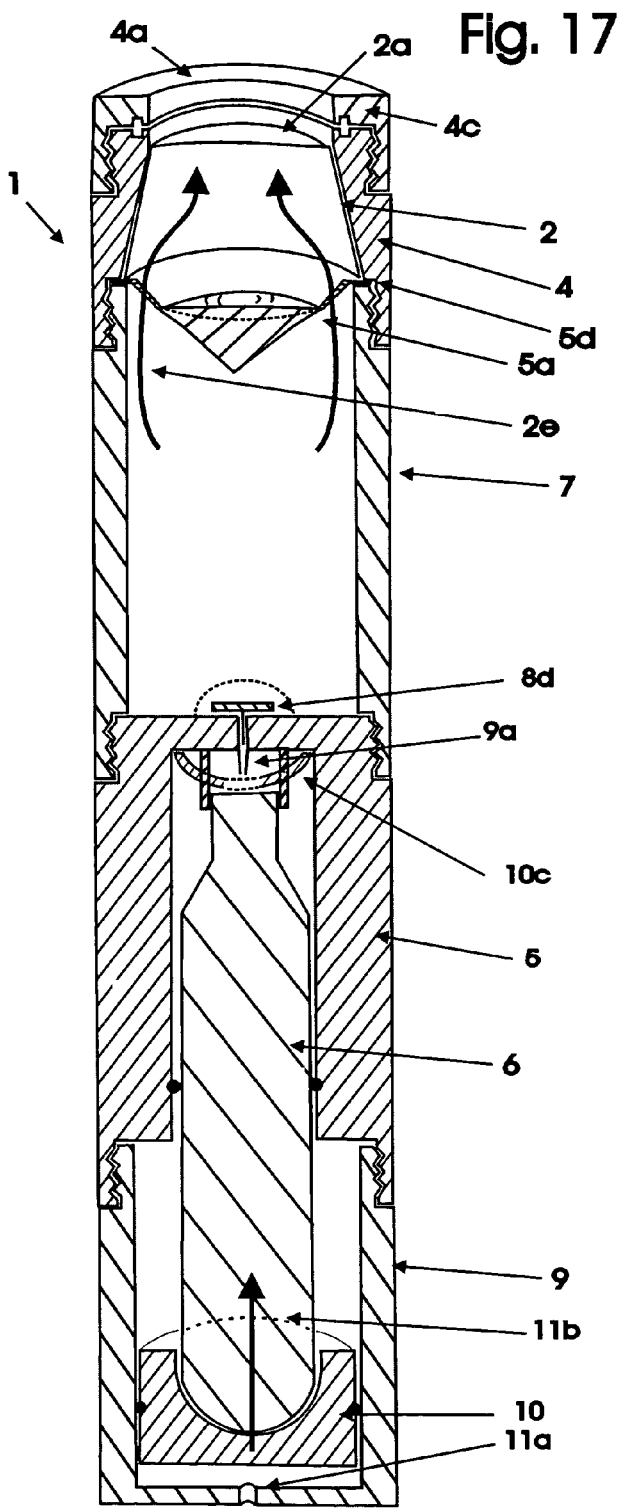
FIG. 17 is a cross-sectional perspective view of a gas projector 1 that is actuated by the compressed gas cartridge 6 being pushed by force 11*b* into stationary lance 9*a*, rather than visa versa, as illustrated in FIG. 1.

FIG. 17 illustrates another embodiment of the invention. This is a simple, modular system in which the compressed gas cartridge 6 is pushed by a piston 10, in response to an input at 11*a* of force 11*b*, which moves the piston 10 forward and the compressed gas cartridge 6, into a vented lance 9*a*, well known to the art. This embodiment used a gas cartridge with a seal type valve, but it is apparent that other embodiments could just as easily use another type of valve, well known to the art, including a high volume valve instead. FIG. 17 includes an optional spring 10*c* to reset the tank and piston at the completion of the desired release of gas from the tank. In this example the spring is a Belleville washer 10*c*, but a coil spring, or other spring might just as easily be used. The preferred embodiment illustrated in FIG. 17 also includes a simple valve 8*d*, which could be a flapper valve or other type well known to the art to prevent particulate matter from back flowing into the lance 9*a* and cartridge 6 or piston 10. FIG. 17 includes a sonic energy concentrator 5*a*, which is suspended from the walls forming the chamber 7, by one or more supports, around which the gas flow 2*e* is free to pass. This embodiment of the invention can accommodate a burst hat 2 as illustrated, or a wafer burst disk at 4*c*, or both.

Figure 18:
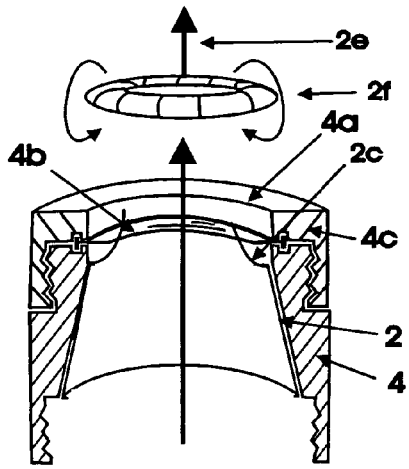
FIG. 18 is a cross-sectional perspective view of an accessory cap 4*c* that is attached to or can form the top part of the burst hat seal 4, as it does in FIG. 17.

FIG. 18 illustrates the pressure release unit including a burst hat 2 and a vortex generator 4*b* which can screw into or be attached by other means to a gas projector 1, such as that illustrated on FIG. 16.

Figure 19:
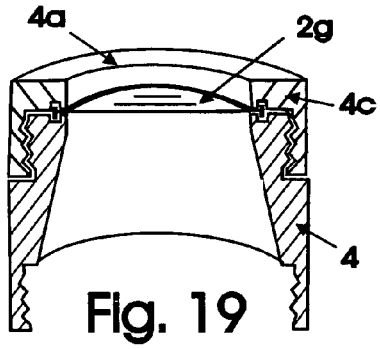
FIG. 19 is a cross-sectional perspective view of an accessory cap 4*c* that secures a wafer burst disk 2*g* that is similar to the burst disk portion 2*a* of the burst disk hat 2, but usually has a rim that indexes with the slot formed partly in the cap 4*c* and partly in the top of the burst hat seal 4, as illustrated in FIG. 19. The integrity of the seal is accomplished by pressure exerted on the seal 2*g* by the accessory cap 4*c* being turned down on threads against the burst hat seal 4, or other similar method.

Although the embodiment of the invention illustrated in FIG. 19 shows only one retainer ring 4*c*, that accommodates a simple burst disk, it should be noted that any number of retainer rings 4*c*, could be stacked on top of each other, with appropriate connecting threads, or other means, to produce the desired effects. For example, a simple wafer type burst disk 2*g* might be in the bottom retainer rings 4*c*, and an additional retainer ring, immediately above it, might retain a vortex ring generator 4*b*.

Figure 20:
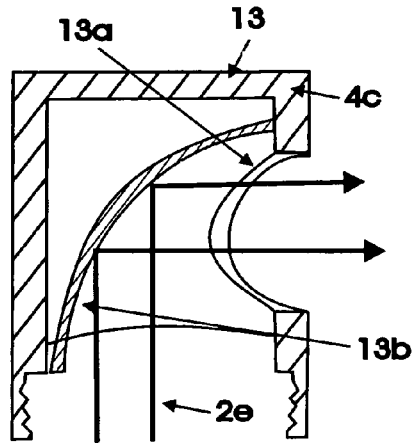
FIG. 20 is a cross-sectional perspective view, which illustrates an accessory cap 4*c* that has a deflector 13*b*, which redirects the flow of gas and entrained matter 2*e* out of port 13*a*.

FIG. 20 illustrates a side-firing pressure release unit with redirecting vane 13*b* that provides redirecting means to the top of the gas projector 1, illustrated on FIG. 17. This particular accessory is side firing, with deflector vane 13*b* redirecting the flow 2*e* at 90 degrees, through port 13*a*. It should be noted that these preferred embodiments are meant to be only illustrative of the principal of redirecting the flow, and other embodiments of the invention can project the flow in various directions, and be within the ambit of the invention.

Figure 21:
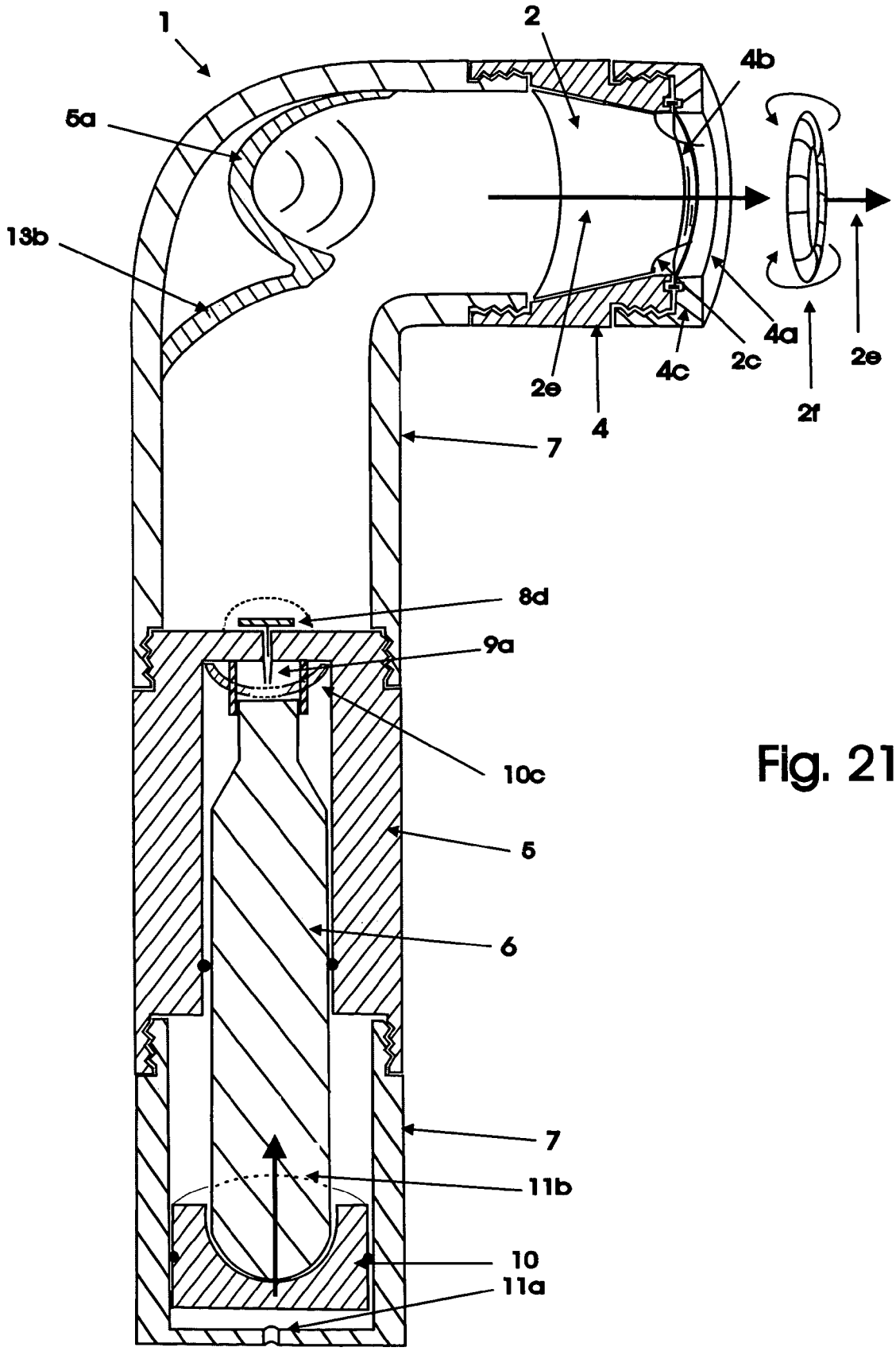
FIG. 21 is a perspective view of a gas projector 1 having an angled gas chamber 7, such that the burst hat seal 4 and the burst hat 2 are at approximate right angles to the longitudinal axis of the compressed gas cartridge 6.

FIG. 21 illustrates a further way in which the air projector illustrated on FIG. 17 can be modified to project the sonic report and payload, if any, in any particular direction. In the example illustrated in FIG. 21, this is 90 degrees, but other embodiments could direct them in any particular direction and be within the ambit of the invention. The embodiment illustrated in FIG. 21 is similar to that illustrated in FIG. 14, and has a similar redirection vane 13*b* and sonic energy concentrator 5*a*. In this example of the invention, the burst disk 2*a* has burst 2*c*, sending a pulse of gas 2*e* past the vortex ring generator 4*b*, to produce a vortex 2*f*.

Figure 22:
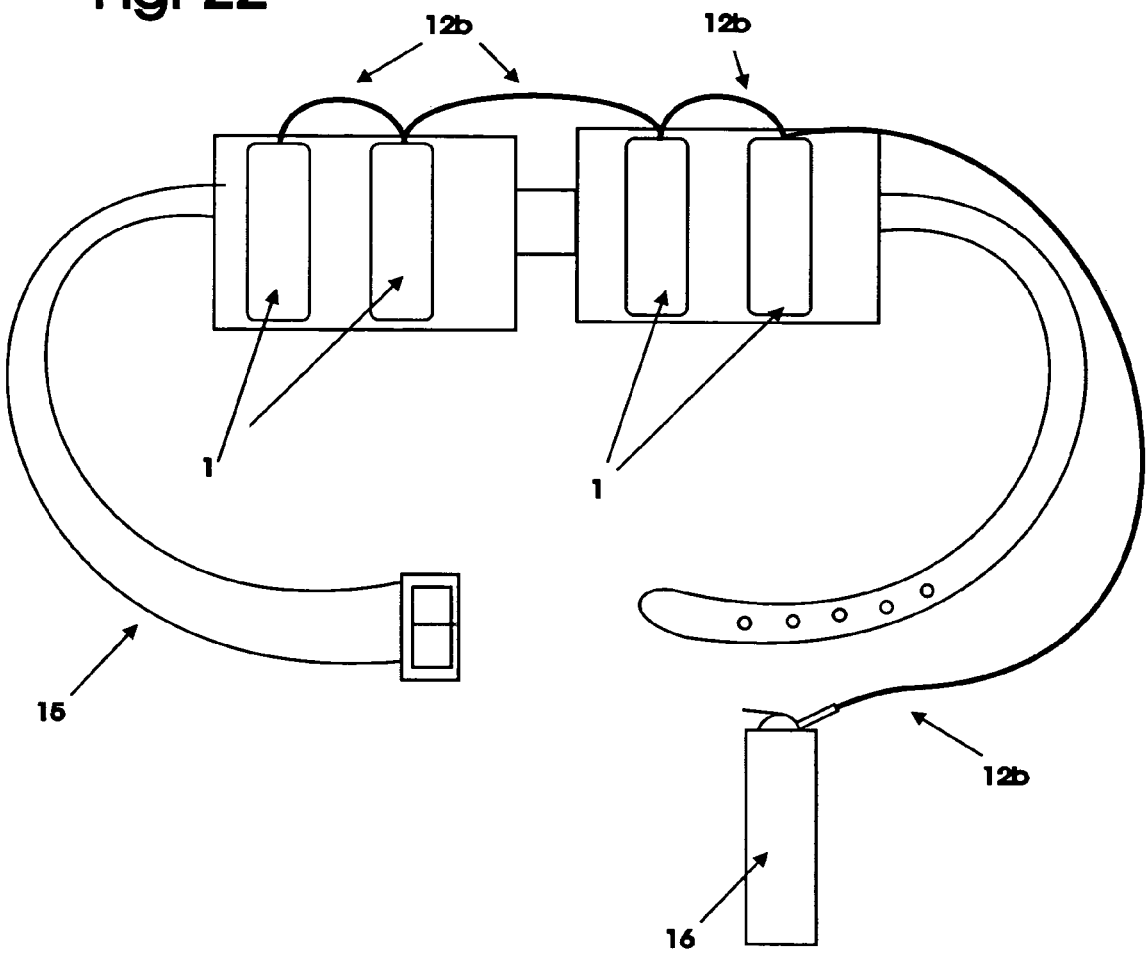
FIG. 22 is a perspective view of a facsimile explosive vest, with belt 15, to which have been secured four gas projectors 1 such as those illustrated on FIG. 20.
Figure 23:
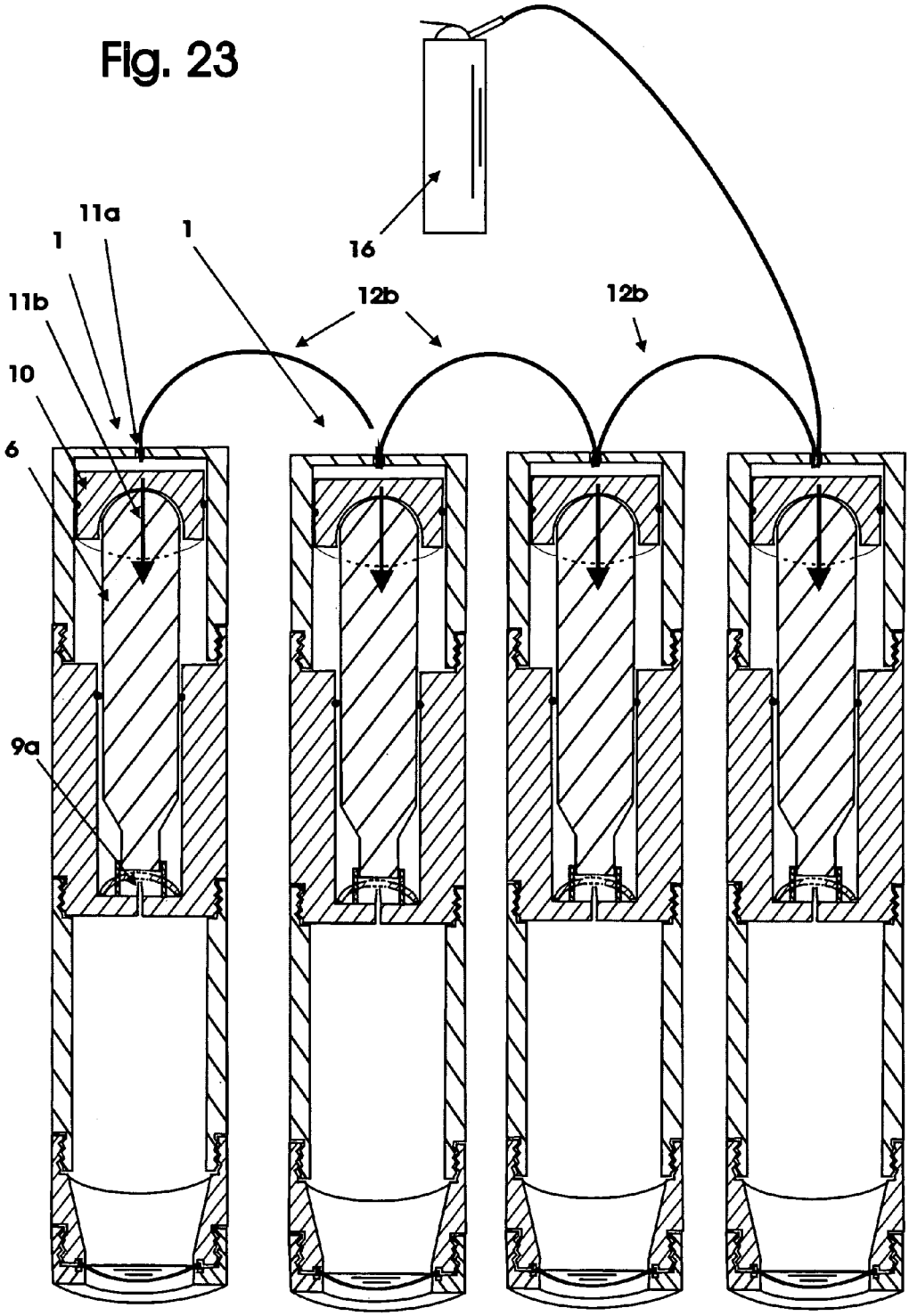
FIG. 23 is a cross-sectional perspective view of four gas projectors 1, that form the vest, illustrating the hydraulic fluid, under pressure, that is provided by the tubes 12*b*, pushing 11*b* the piston 10 that in turn pushes the compressed gas cartridges 6 forward into the lance 9*a*, initiating the projection of gas and perhaps entrained matter.

FIG. 22, and FIG. 23 illustrate how the gas projectors can be daisy-chained together to ignite at approximately the same time. In these examples of the preferred embodiment a number of gas projectors 1 are placed in a vest that is meant to simulate a suicide vest, for training security personnel. In this example of the preferred embodiment, the gas projectors 1 are secured to a belt 15, which is cinched around part of a person's body. The canister 16, containing a fluid or gas can be motivated by the operator to travel down the tube 12*b* and cause the gas to be released from gas cartridge 6, by such means as described in the forgoing examples. FIG. 23 illustrates gas projectors 1, that are similar to those illustrated on FIG. 17, but any gas projectors can be used and come within the ambit of the invention. The tubes 12*b* can be connected to the gas projectors at 11*a* and cause all the pistons 10 to move in direction 11*b* all at approximately the same time. This will result in the gas being released at approximately the same time, and then a loud report and projection of the payload, in a manner described above.

Figure 24:
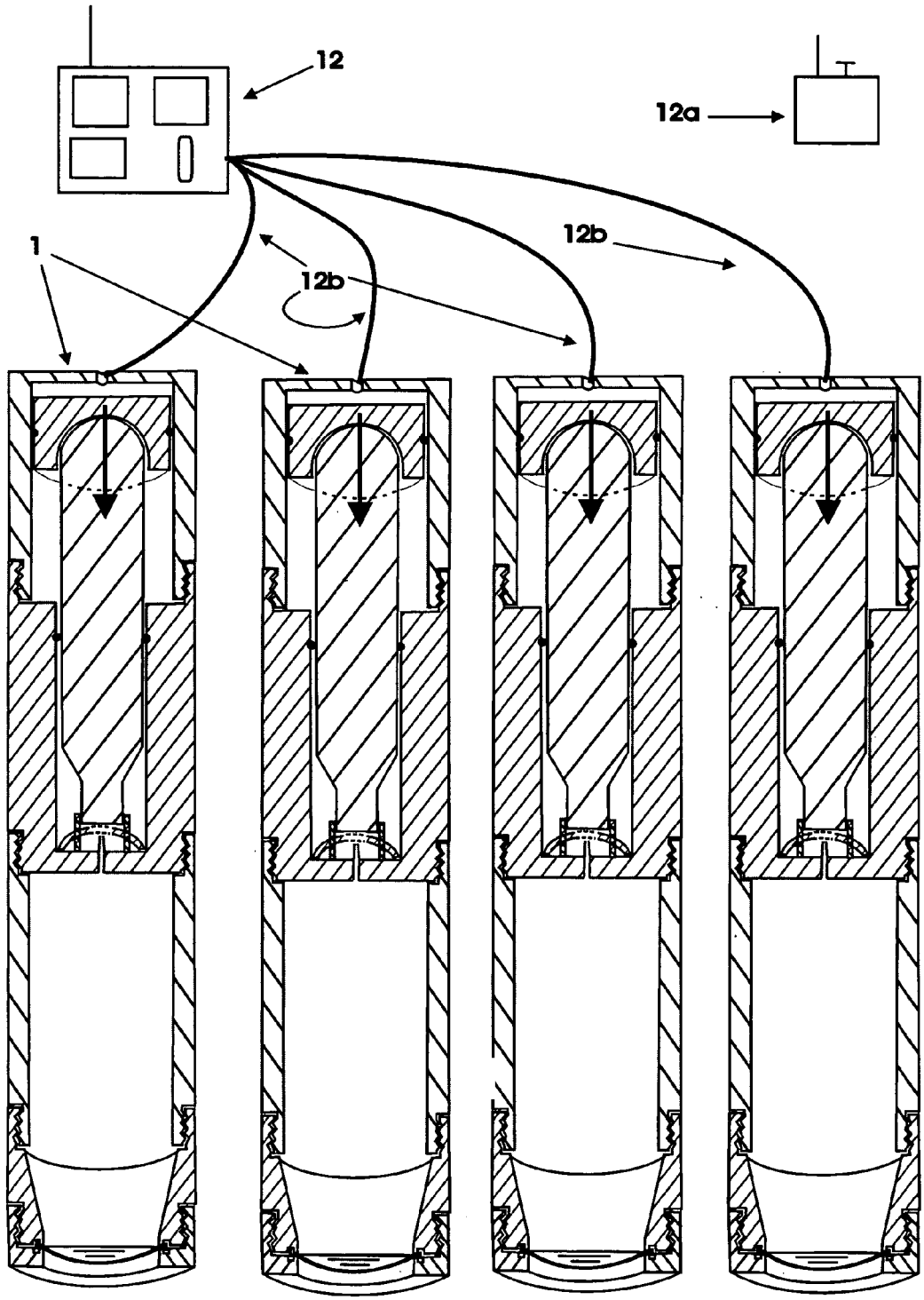
FIG. 24 is a cross-sectional perspective view of four gas projectors 1, which are individually, controlled by controller 12 and in some examples a remote switch 12*a*.

FIG. 24 illustrates how the gas projectors can be individually connected to controlling means similar to that described in FIG. 14. In this example the controlling means direct the fluid or gas down tubes 12*b* individually, so that the gas projectors 1 can be made to ignite in any sequence desired. The controller might be equipped with a wired or wireless remote control to control part or all of the functions of the controller itself.

Figure 25A:
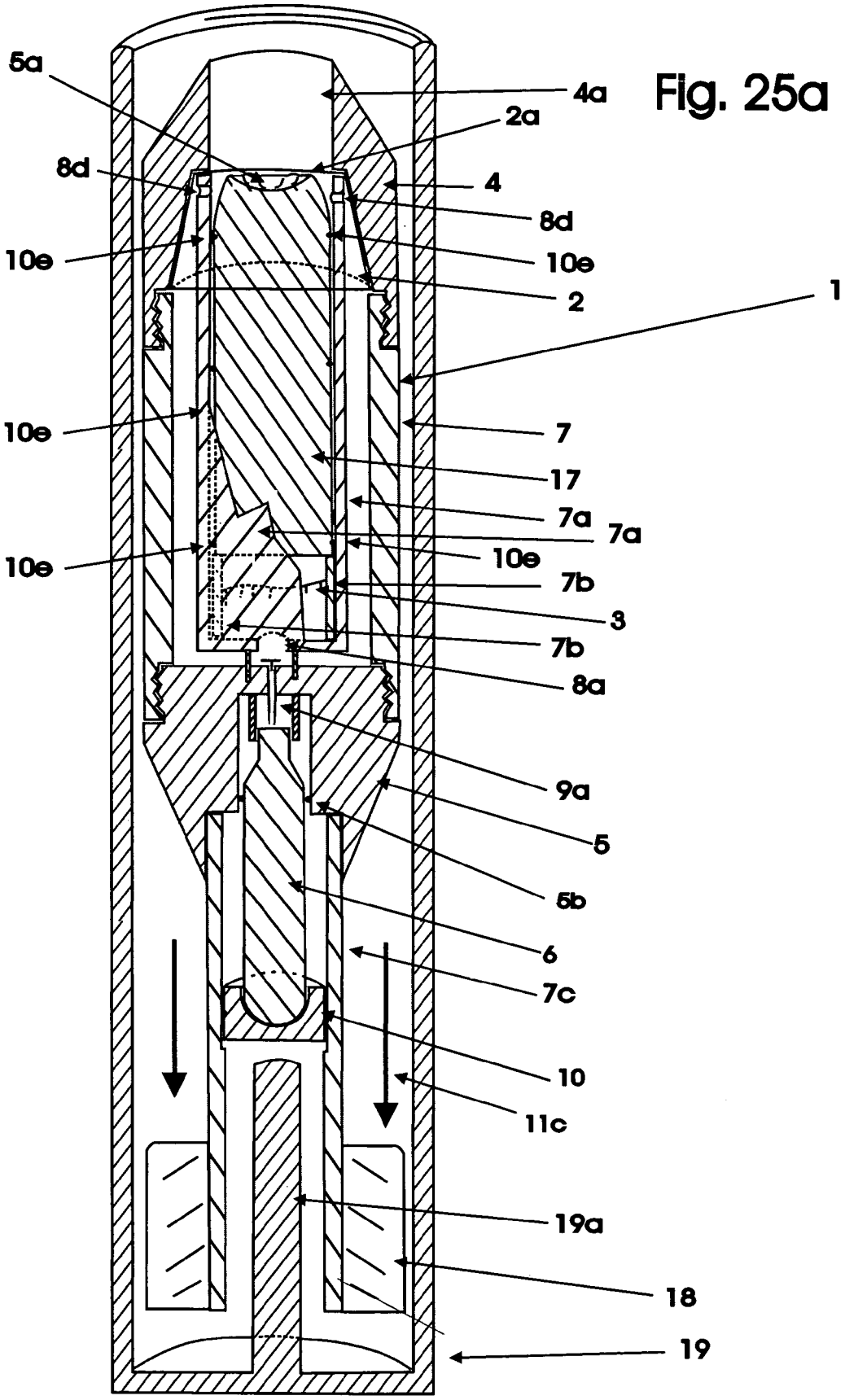
FIGS. 25*a*, 25*b* and 25*c* are cross-sectional perspective views of a gas projector, in the form of a facsimile mortar.
Figure 25B:
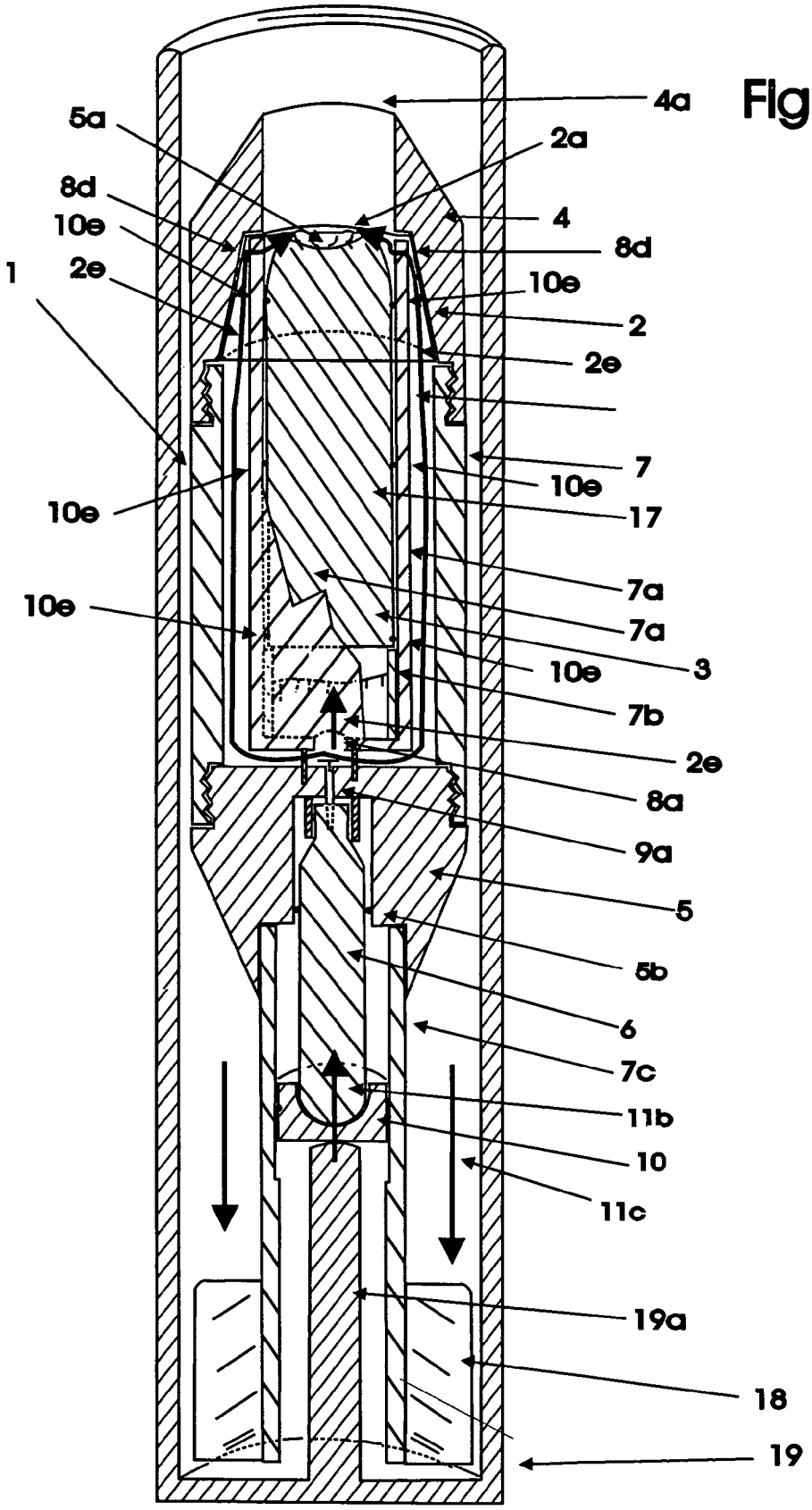
Figure 25C:
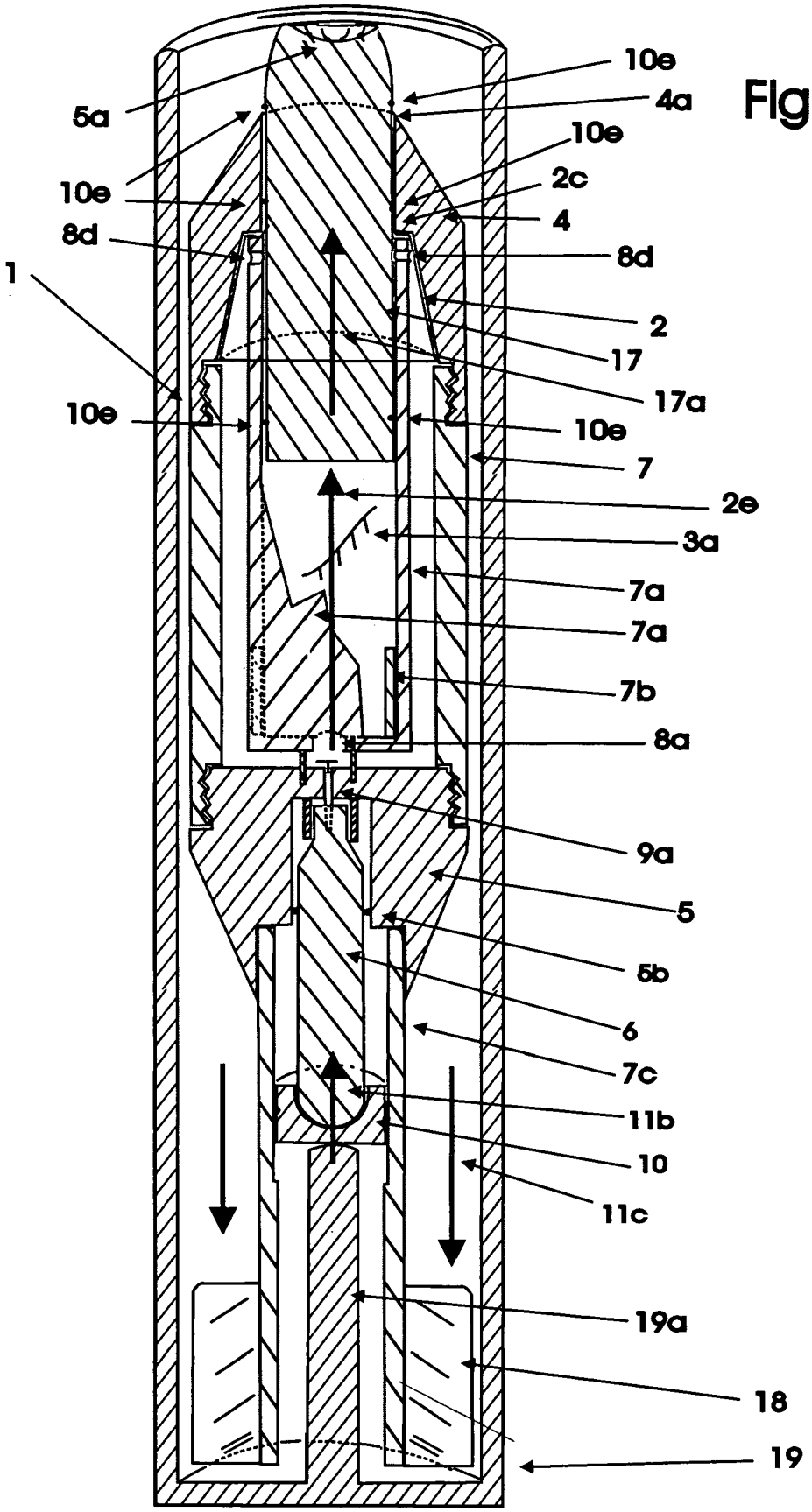

As mentioned above, the invention can take many forms. The preferred embodiment of the invention illustrated on FIGS. 25*a*, 25*b* and 25*c* is in the form of a mortar. It however has the principal elements of the invention, as will be appreciated in its detailed description. The mortar tube 19 is simply a tube with a closed end at one end, the base, and an open end at the other. The gas projector 1 is similar to that illustrated in FIG. 17, but with the addition of a tail fin 18, a streamlined cartridge holder 5 and burst hat seal 4, as well as a payload tube 7*a*, nosecone 17 (the mortar projectile) and additional gas ports 8*d*.

FIG. 25*a* illustrates the mortar round (the gas projector 1) being dropped 11*c* into the mortar tube 19, at that point just before the rod 19*a* makes contact with piston 10. At this point the compressed gas cartridge 6 is not discharging any gas.

FIG. 25*b* illustrates the mortar round (the gas projector 1) being dropped 11*c* into the mortar tube 19, at that point just as the rod 19*a* has made contact with piston 10 and moved it and the abutting gas cartridge 6 in direction 11*b*; causing the lance 9*a* to break the seal in said gas cartridge 6. The released gas 2*e* then moves through passage 8*a* into the bottom of the payload tube 7*a*. Simultaneously the released gas 2*e* passes around and up the space between the payload tube 7*a* and the walls of the barrel or chamber 7, through ports 8*d*, (the ports 8*d* being the only passage available to the top of the nosecone) and into the space between nose cone or plug 17 and the burst disk 2*a*. At this point the nosecone 17 does not move vertically, as the gas pressure is the same at the bottom as the top; and also the nosecone 17 may be restrained by some of its upper surface coming into contact with the bottom of the burst disk 2. The "O" rings 10*e* maintain a sliding, gas tight seal, between the nosecone 17 and the payload tube 7*a*. As the gas pressure in the barrel 7 rises, the burst disk bulges, as illustrated on FIG. 25*b*.

At some point the gas pressure in the barrel 7 rises to the point that the burst disk 2*a* bursts 2*c*. FIG. 25*c*, illustrates what happens at after this point. After the burst disk fails 2*c*, the gas pressure at the top of the nosecone suddenly drops relative to the gas pressure at the bottom of the nosecone. This causes the nosecone to move up the tube thereby covering the ports 8*a* and cutting off further movement of gas through these ports 8*a*. All the gas that continues to be released 2*e* then acts just on the bottom surface of the nosecone 17, projecting it upward 17*a*.

In the preferred embodiment of the invention, the nosecone contains a sonic energy concentrator 5*a*. This can be in any shape, as mentioned earlier, however, in most applications it will be a concave shape in the top of the nosecone, which creates a secondary resonant chamber, concentrating and promoting the sonic shock front, and also acting as a bell or horn, projecting the sound forward. It is important to note that this embodiment of the invention is consistent with the separation of the gas, that drives the shock front and causes the report, from the gas the later projects the payload. That is, the gas that drives the shock front is unencumbered by payload. In FIGS. 25*a*, 25*b* and 25*c*, the payload is the nosecone 17 and the particulate matter 3 and 3*a*. Note also that when the gas enters port 8*a*, the gas fluidizes the particulate matter as the nosecone is elevated on member 7*b*, creating a space above the particulate matter 3 and bellow the bottom of the nosecone 17.

Figure 26A:
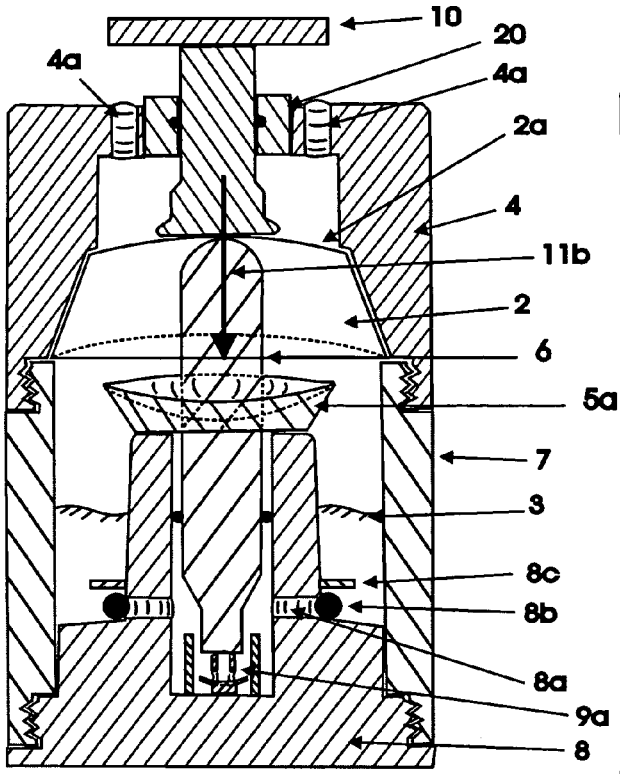
FIG. 26*a* and FIG. 26*b* are cross-sectional perspective views of a gas projector, in the form of a facsimile mine, that is actuated by something imparting sufficient pressure, in this example a boot 24, on piston 10 that imparts a force 11*b*, and presses the compressed gas cartridge 6 into lance 9*a*, opening a valve or piercing a seal, and thereby releasing the compressed gas within the compressed gas cartridge 6.
Figure 26B:
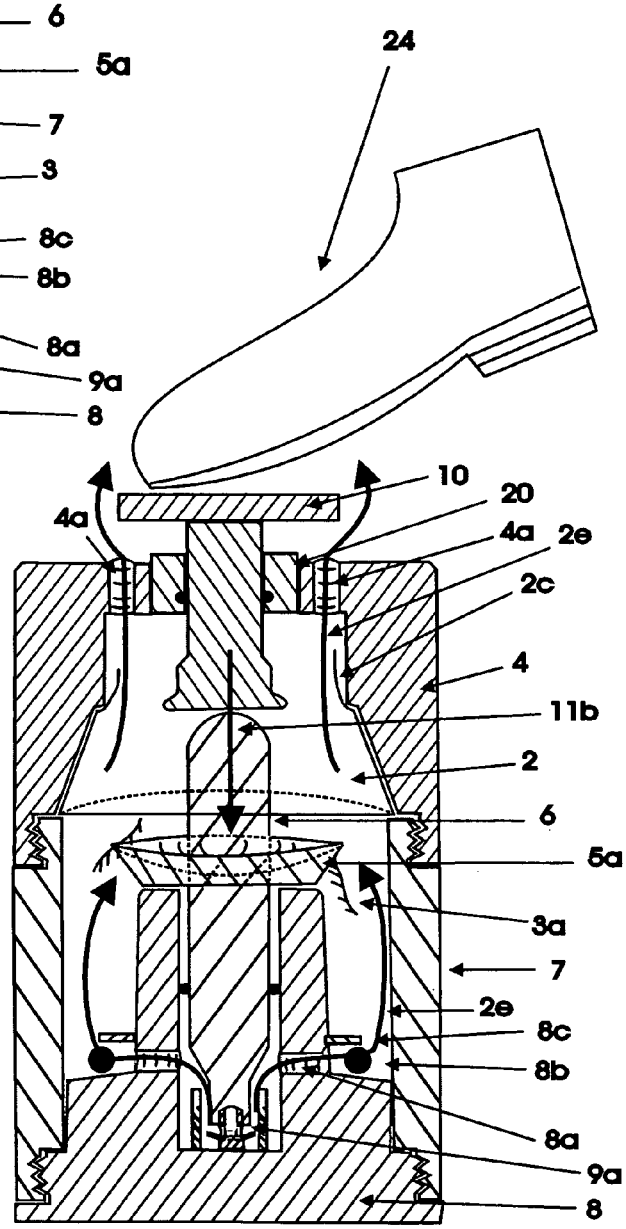

FIGS. 26*a* and 26*b* illustrates a further embodiment of the invention that incorporates the principal features that comprise the invention in a form that resembles a foot depression mine. As one can readily appreciate, the embodiment illustrated in FIGS. 26*a*, 26*b*, 27*a* and 27*b* all resemble the gas projector illustrated in FIG. 1 and FIG. 5, except that in the former group of embodiments, the piston 10 pushes the compressed gas cartridge 6 into the lance 9*a*, rather than the other way around. Also the piston 10 and gas cartridge 6 are separated by the burst disk 2*a*, which is somewhat flexible and allows sufficient movement of both, without bursting. The preferred embodiment illustrated in FIGS. 26*a* and 26*b* include a sonic energy concentrator 5*a* that can take many shapes, but most are in the form of a concave surface that creates a secondary resonant chamber that, as mentioned above, enhances the force of the shock front and the consequent volume of the report, while also acting like a bell or horn, projecting the sound forward and away from the device. After the piston 10 is depressed, sliding through a bushing 20, located in the burst hat seal 4, as illustrated in FIG. 26*b*, the gas is released from the compressed gas cartridge 6 and advances 2*e* up the chamber 7, thence around the sonic energy concentrator 5*a*. When the pressure is sufficiently high to burst the burst disk 2*c*, it advances through ports 4*a* and beyond. It is important to note that in this embodiment, the sonic energy concentrator, provides some further means of separating the first blast of air that breaks the burst disk 2, 2*c* from the payload 3, in this example, particulate matter 3, even when the air blast, floats the material somewhat, readying it for transport, as the pressure drops and the air begins to stream 2*e* entraining the payload.

FIGS. 26*a*, 26*b*, 27*a* and 27*b* all have "O" rings 8*b* and restraining means 8*c* that prevent any particulate matter or other debris from back flowing into the valve. This novel use of an "O" ring that transforms it into a valve by radial expansion and compression is an important feature of the invention, and is found on many implementations of the invention.

Figure 27A:
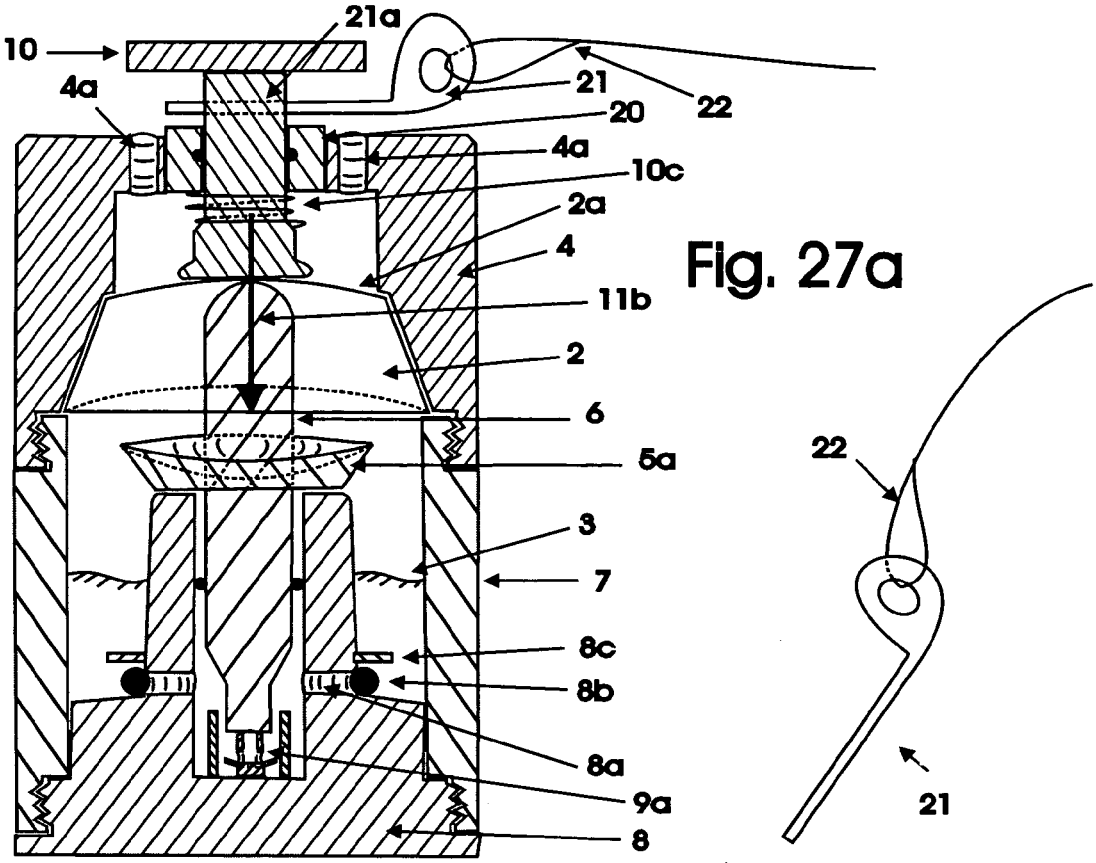
FIGS. 27*a* and 27*b* are cross-sectional perspective views of a gas projector, in the form of a facsimile mine, that is actuated by something pulling on a trip wire 22, which in turn removes trip pin 21 from piston 10. Once the restraining trip pin 21 has been removed, compressed spring 10*c* is free to recover and act with force 11*b* forcing piston 10 to in turn force gas cartridge 6 against lance 9*a*, thereby piercing seal or opening valve to release the compressed gas contained in gas cartridge 6.
Figure 27B:
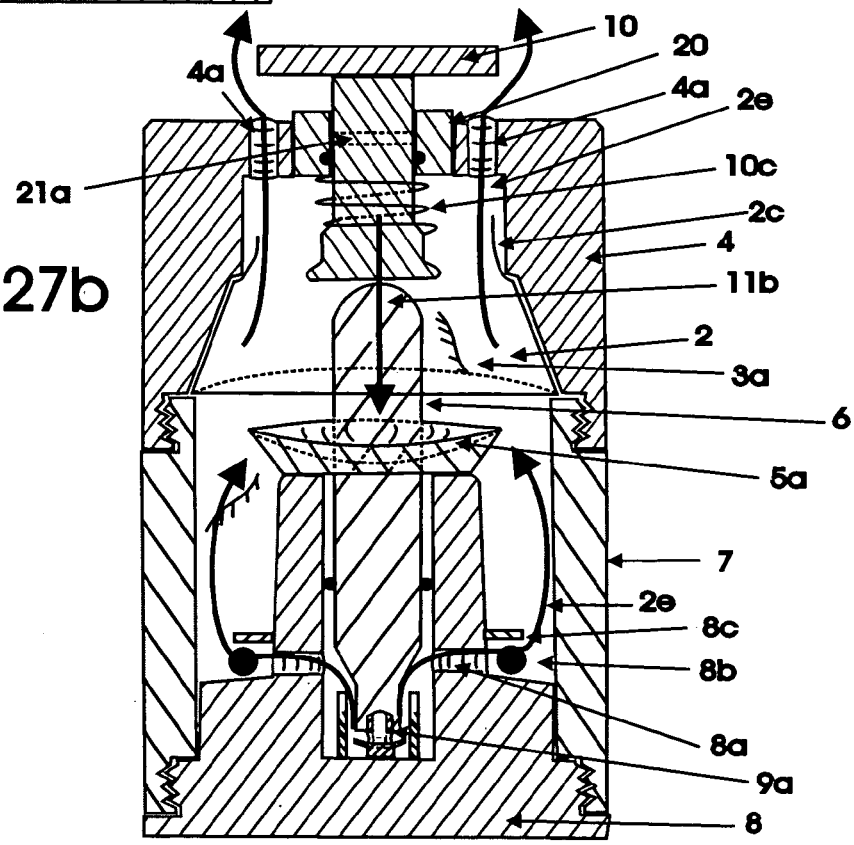

FIGS. 27*a* and 27*b* illustrate a tripwire type of mine and is identical to the compression mine, illustrated in FIGS. 26*a* and 26*b*, except that the spring 10*c* is preloaded by pulling the piston 10 up and temporarily latching it in that position. For example, FIGS. 27*a* and 27*b* illustrate a cotter pin 21 that has been inserted into a hole 21*a*, in the piston 10, while the spring has been put into compression. In FIGS. 27*a* and 27*b*, a tripwire 22 has been connected to the pin. When the tripwire is pulled, the spring 10*c* recovers, drawing the piston down into the chamber 7, and pressing the compressed gas cartridge 6 into the lance 9*a*, causing the chamber 7 to pressurize, and the burst disk 2 to burst 2*c*.

The tripwire mine illustrated on 27*a* and 27*b* both have sonic energy concentrators 5*a* and "O" rings, which serve the same purposes as they do on the other embodiments of the invention herein.

It should be noted that while the reference has been made herein to gas cartridges, it should be understood that the any gas supply would suffice, whether inside the device or partly or completely outside it.

It should also be noted that there are many methods of controlling the flow of the gas, will known to the art, including electronic, electrical, pneumatic, hydraulic types, to name just a few example. It should be understood that embodiments that contain any of these methods, which are well known to the art, are within the ambit of this invention.

It should also be understood that the invention is not limited to the examples given in this disclosure, but are examples of a larger class of sound and material projection devices, or both.

While the burst hat 2 and the burst hat seal have a complementary conic-cylindrical shape, it is to be understood that they may be any shape, provided they present the seal disk 2*a* to the air flow or pressure 2*e* to effect the purpose of causing the seal disk 2*a* to burst 2*c*.

While the embodiments of the invention are described mostly in the context of using a burst disk to cause a sudden venting of the compressed gas flow, sufficient to cause a loud report, as herein described, it is to be understood that this is only an example of high-speed methods of tuning on the flow of gas, and can utilize other high speed valves, of whatever types.

While the preferred embodiment of the invention locates the sonic shock concentrator inside the exit port of the gas projector, the exit port being the last orifice on the device, in the gas stream 2*e*, it is to understood that some embodiments of the invention, can locate the sonic shock concentrator 5*a* outside the said exit port, in the exiting gas stream 2*e*.

While the preferred embodiment of the invention illustrates various means of actuating the valve 6*c* or breaking the seal 6*a* of the compressed gas cartridge, it should be understood that these are merely illustrative of many means well known to the art. For example the gas projector could be made in the form of a gun and the lance 9*a* could just as easily be actuated by a finger trigger that would cause the lance 9*a* to move forward, releasing the compressed gas, whether in a canister or supplied externally to the device.

While many features of the invention have been illustrated in forms that resemble explosive devices and munitions, it is to be understood that the gas projectors can take many forms, such as firecrackers, confetti guns, to name just a few. It should also be noted that certain embodiment can have any combination of features that comprise the embodiments of the invention and still be within the ambit of the invention herein disclosed.

While the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the inventions and appended claims.

What is claimed is:

1. A gas projector device comprising a substantially air tight barrel or chamber which contains at least one exit port through the wall of the barrel, the passage through which is controlled by a valve, which may be a burst disk, that can open substantially instantaneously, and a gas that is at a pressure substantially greater than the ambient pressure outside the barrel, and when the said valve opens substantially instantaneously, the said gas that is at pressure in the barrel, is released through such valve, and collides with the ambient air outside the barrel, and does so with sufficient force to cause a sonic report, and the remaining gas in the barrel, entrains some or all payload material matter that may be located within the barrel, and transports it out of the barrel, through the said valve.

2. A gas projector device comprising a substantially air tight barrel which contains: at least one exit port through the wall of the barrel, the passage through which is controlled by a valve, which can be a burst disk, that can open substantially instantaneously, and a gas that is at a pressure substantially greater than the ambient pressure outside the barrel, and a vortex generator proximal to the exit port and said valve, such that one or more vortexes are created by the vortex generator when said gas is released substantially instantaneously by said valve, creating a pulse of gas that is suitable for the creation of a vortex, when passed through that particular vortex generator, and such vortexes may carry payload, away from the device, and or create percussive impacts that can be perceived by persons that are in their path.

3. The gas projector device of claim 1, wherein two or more resonant cavities are harmonically tuned, and one cavity is used to pump the other, by the device of intermittent pulses, created in the first cavity, causing an upward cascade of harmonic resonances in the second cavity, and which at some predetermined energy pressure, is released out of the barrel by opening the said valve or selecting a burst disk that is designed to open substantially instantaneously at a range of said predetermined energy pressures, causing one or more loud reports.

4. The gas projector device of claim 1, wherein a sonic energy concentrator is located adjacent to the said exit port, and the said sonic concentrator shapes and/or intensifies the sound and accelerates and/or intensifies the sonic shock front, at and after the valve, or burst disk is substantially instantaneously opened, releasing the pressurized gas into the ambient air.

5. The gas projector device of claim 1, wherein the sonic concentrator forms substantially one end of a resonant chamber or column, the opposite end being substantially formed by the said valve, which can be a burst disk, that opens substantially instantaneously, and such resonant chamber or column enhances the propagation of sound energy projecting from and adjacent to the said port(s).

6. The gas projector device of claim 1, wherein the sonic concentrator forms a sound and pressure reflector and/or deflector that directs and redirects sound from inside the exit port of the barrel, through the said valve and port(s) to the exterior of the barrel.

7. The gas projector device of claim 1, wherein the said valve can be comprised of a bursting disk, including a slotted bursting disk that substantially instantaneously releases the gas pressure within the barrel when the pressure in the chamber increases to a predetermined range of pressures and the out rushing gas causes a sonic report when it collides with the relatively still ambient air.

8. The gas projector device in claim 1, wherein the flow of pressurized gas through the chamber, attendant with the opening of the said valve, fluidizes that particulate matter or other matter, within the chamber and then entrains and transports the said matter through the said port and valve, in combination with directing and deflecting means.

9. The gas projector device in claim 1, wherein the bursting disk is part of a burst hat container that contains a particular payload, in a particular amount, the contents of which can be accessed by tearing, peeling away, or opening a cover, and then either emptying the contents into the chamber or placing the whole burst hat container, before or after partly or wholly opening the same, into a sealing receptacle such as a burst seal, such that the burst disk is approximately normal to the direction of the flow of gas through the disk, when it bursts.

10. The gas proiector device in claim 1, wherein the burst hat container has a channel defined within it, for example by inserting within it a tubular or channel member, and/or by impressing a channel within the material and perhaps stabilizing the said channel chemically, or such channel is imparted into it by, or supported, by pressing it onto a tubular member extending from the sonic concentrator, and/or the cartridge holder.

11. The gas projector device in claim 1, wherein one or more of the devices are combined with a belt or sash that simulates a suicide bomber's vest, belt, sash or other garment.

12. The gas projector device in claim 1, wherein one or more of the devices are simultaneously or at separate times ignited by remote control means that may be wired or wirelessly connected to controllers that the operator can manipulate.

13. The gas projector device in claim 1, wherein the compressed gas is delivered to the interior of the said barrel, from compressed gas cartridges or supplies that are located inside or outside the barrel, and such gas is released into the interior of the barrel by opening a gas supply valve or piercing a seal in such container, and such released gas raises the pressure of the gas in the interior of the barrel, and such gas is directed first to the valve, which can be a burst disk, virtually free of any payload to produce the highest velocity collision between the gas that is first substantially instantaneously released by the valve, and the ambient air outside the barrel, and any remaining gas in the said barrel may float payload within the chamber, and may entra ins some or all of such payload and carry it outside the gas projector.

14. The gas projector device in claim 1, which may resemble a mortar, wherein the compressed gas is delivered to the interior of the said barrel, from compressed gas cartridges or supplies that are located inside or outside the barrel, and such gas is released into the interior of the barrel by opening a gas supply valve or piercing a seal in such container, which may be initiated by the downward force of the gas projector being dropped in a container, which may resemble a mortar tube, and the bottom of the said container has a projection that first comes in contact with a part of the gas projector, that causes the gas, under pressure, to be released into the barrel, and such released gas raises the pressure of the gas in the interior of the barrel, and prior to the burst disk bursting, or the valve in its place opening substantially instantaneously, such gas is directed to both the top and the bottom of that part of the payload that is a plug or nosecone, substantially simultaneously, creating volumes of substantially equal pressure at the top and bottom of the nosecone, and this equal pressure, tending to keep the nosecone in place relative to the payload tube, perhaps in addition to points of contact between the top of the nosecone and the underside of the burst disk, and the gas that is delivered to the top of the nosecone, is delivered between the walls of the chamber and the payload tube, and little gas passes directly between the lumen of the payload tube and the facing side of the nosecone, due to the small space between them as well as perhaps, sliding seals, such as "O" rings located at intervals around the nosecone, and the gas that is delivered to the top of the nosecone passes through at least one port in the payload tube, that allows the gas to travel to the top surface of the nosecone, which in some preferred embodiments has the shape and functions as a sonic energy concentrator, and when the burst disk bursts, or the valve in its place opens, substantially instantaneously, the gas volume, between the nosecone and the bottom side of the burst disk, suddenly accelerates, unencumbered by payload, collides with the relatively still ambient air, and the pressure on top of the nosecone almost immediately drops, relative to the pressure acting on the bottom surface of the nosecone, and only then, the nosecone accelerates in the direction of relatively low pressure and out of the payload tube, and out of the gas projector, and as the nosecone moves out of the payload tube, the nosecone covers the port(s) that transmitted the gas to the top of the nosecone, substantially cutting off any further gas being transmitted to any volume not acting directly on the bottom of the payload, including the nosecone, and from this point in time, all gas pressure is then substantially, exclusively applied to the bottom of the nosecone, and other payload, and the nosecone and other payload if any are expelled from the payload tube.

15. The gas projector device in claim 4, wherein the bursting disk is of the split variety, permitting repeated pulses, and distal to the said split bursting disk maybe located a vortex generator that converts the said pulses of gas into a string of vortexes, and which said string of vortexes can transport particular matter and/or create a series of percussive impacts that can be felt by persons in their path and safely simulate explosive events of real ordinance.

16. The gas projector device in claim 1, having at least one "O" ring that acts as a valve preventing payload from back flowing from the barrel into the gas delivery channel(s), by elastically constricting and sealing said channels, which terminate in a annular groove, in which the "O" ring resides, and the "O" ring is sized so that it elastically seals the end of the channels, but when the gas in the said channel(s) presses against the inside surface of the "O" ring with such force that it exceeds a predetermine threshold pressure, the "O" ring will expand radially a sufficient amount to permit the gas to pass by the "O" ring, but when the said pressure falls bellow the said threshold, the "O" will reseal the channel(s), and prevent any backflow of payload into the channel, and the annular ring in which the "O" ring resides, is shaped so that even when the "O" ring expands sufficiently to allow the pressurized gas to pass out of the channel into the barrel, the "O" ring will still be within the groove's sloped and converging sides, or pegs, and when the said gas pressure drops below the said threshold, these sloped and converging sides or pegs guide the "O" ring back to the part of the groove it occupies when it seals the channel(s).

17. The gas projector device in claim 1, wherein vanes and deflectors form part of the gas projector and direct, and redirect the flow of gas as it exits the said valve or bursting disk, in various patterns and directions.

18. The gas projector device in claim 1, wherein the lance that pierces the seal of the compressed gas cartridge, or opens the valve of the said cartridge, includes channels that allow the gas to escape the cartridge and be redirected directly or indirectly into the barrel of the said projector device, and the lance is fitted with a rim or fins that prevent the escaping gas and condensate from entering the piston or mechanism that actuates the said lance.

19. The gas projector device in claim 1, wherein the sonic energy concentrator and/or reflector has cup which fits over the compressed gas cartridge, which positions it in relation to the valve or burst disk to create a separate resonant chamber or column.

20. The gas projector device in claim 1, produces realistic smoke clouds by aerating and floating payload that is comprised of fine particular matter such as talc or baby powder, and entrain ing it with relatively slow moving air, at relatively low pressures, when compared to that high pressure that create the loud report.

21. The gas projector device in claim 1, that creates a pressure front and/or vortex that can be felt by a person and which simulates a shock front that propagates from explosive devices, including guns, for various purposes, such as soldier training, and mock warfare, in addition to perhaps the smoke and loud report.

22. The gas projector device in claim 1, that combines the sonic energy concentrator, into the surface of a payload that faces the valve or burst disk.

23. The gas projector device in claim 1, that resembles a mortar, and when the gas projector is dropped down a tube resembling mortar tube, in the same way a normal mortar would be operated, the mortar tube includes a probe or other feature that actuates the valve or lance that released the gas in compressed gas cartridge into the barrel of the gas projector, and the released gas pressurizes the barrel and initiates the process by which the gas projector creates a loud report and projects the payload out of the exit port.

24. The gas projector device in claim 1, that are formed into various mock explosive devices, such a roadside bombs, suicide vests, mines, artillery shells and mortars.

25. The gas projector device in claim 1, wherein there are more than one valve and or burst disk, which are coordinated to create resonant effects to increase the effectiveness of the device.

26. The gas projector device in claim 1, wherein the sonic energy concentrator or similarly shaped dish shaped separator, separates the initial gas blast, that breaks the burst disk, from the payload, which may be partly floating or aerated.

27. The gas projector device in claim 1, wherein the device resembles a mortar shell and the said gas projector 1 contains, and propels a projectile that simulates the mortar shell leaving the mortar tube, leaving behind the remaining gas projector in the mortar tube.

28. The gas projector device in claim 1, wherein the device has a valve, actuated by the travel of the projectile out of the projectile tube, that covers at least one port, and transfers the force from the top of the projectile, proximal to the sonic energy concentrator, where it first is applied to bursting the burst disk, and creating a sonic blast to the bottom of the projectile, where it is applied to exclusively projecting the projectile and perhaps other payload, out of the projectile tube, and away from the gas projector and mortar tube.

29. The gas projector device in claim 1, wherein there are vanes to redirect the gas and payload ejected, combined in some cases with an sonic energy concentrator.

30. The gas projector device in claim 1, wherein the burst bust disk is set at various angles, with respect to the longitudinal axis of the gas cartridge.

31. The gas projector device in claim 1, wherein the compressed gas supply is provided by a cartridge within the projector, or is provided by a supply external to the gas projector.

* * * * *